US010408003B2

(12) United States Patent
Moyes

(10) Patent No.: US 10,408,003 B2
(45) Date of Patent: Sep. 10, 2019

(54) DOWNHOLE TOOL

(71) Applicant: Xtreme Well Technology Limited, Kintore (GB)

(72) Inventor: Peter Moyes, Kintore (GB)

(73) Assignee: XTREME WELL TECHNOLOGY LIMITED, Kintore (GB)

( * ) Notice: Subject to any disclaimer, the term of this patent is extended or adjusted under 35 U.S.C. 154(b) by 928 days.

(21) Appl. No.: 14/412,937

(22) PCT Filed: Jul. 2, 2013

(86) PCT No.: PCT/GB2013/051747
§ 371 (c)(1),
(2) Date: Jan. 5, 2015

(87) PCT Pub. No.: WO2014/006392
PCT Pub. Date: Jan. 9, 2014

(65) Prior Publication Data

US 2015/0159449 A1 Jun. 11, 2015

(30) Foreign Application Priority Data

Jul. 4, 2012 (GB) ..... 1211836

(51) Int. Cl.

| | |
|---|---|
| ***E21B 23/01*** | (2006.01) |
| ***E21B 33/134*** | (2006.01) |
| ***E21B 23/06*** | (2006.01) |
| ***E21B 33/129*** | (2006.01) |
| ***E21B 23/02*** | (2006.01) |

(52) U.S. Cl.
CPC ..... *E21B 23/01* (2013.01); *E21B 23/02* (2013.01); *E21B 23/06* (2013.01); *E21B 33/129* (2013.01); *E21B 33/134* (2013.01)

(58) Field of Classification Search
CPC ..... E21B 23/01; E21B 23/02; E21B 23/06; E21B 33/129; E21B 33/134
See application file for complete search history.

(56) References Cited

U.S. PATENT DOCUMENTS

| | | | | | |
|---|---|---|---|---|---|
| 2,175,351 | A * | 10/1939 | Hammond | G05D 23/185 | 236/82 |
| 3,706,342 | A * | 12/1972 | Woolley | E21B 23/06 | 166/134 |
| 5,458,196 | A * | 10/1995 | George | E21B 23/01 | 166/120 |
| 2008/0074086 | A1* | 3/2008 | Schmid | H02P 9/006 | 322/33 |
| 2012/0090894 | A1* | 4/2012 | Laplante | E21B 23/02 | 175/57 |

* cited by examiner

*Primary Examiner* — Yong-Suk Ro
(74) *Attorney, Agent, or Firm* — Eileen Pape

(57) ABSTRACT

A downhole tool includes a slip member having an actuation surface, a bracing surface and an engagement surface. The slip member is pivotable about a pivot axis such that it can move between retracted and extended configurations. When the slip member is in the extended configuration, the engagement surface engages a bore wall. The downhole tool also includes a wedge member that has a wedge surface. The wedge member and the slip member are configured to move relative to each other such that the wedge surface of the wedge member engages the actuation surface of the slip member to cause the slip member to pivot about the pivot axis.

65 Claims, 8 Drawing Sheets

DOWNHOLE TOOL

This application is the U.S. national phase of International Application No. PCT/GB2013/051747, filed 2 Jul. 2013, which designated the U.S. and claims priority to GB Patent Application No. 1211836.0, filed 4 Jul. 2012, the entire contents of each of which are hereby incorporated herein by reference.

FIELD OF THE INVENTION

The present invention relates to a downhole tool, and in particular to a downhole tool which is configured to provide an anchor within a wellbore.

The present invention also relates to a ratchet apparatus, for example for use within a downhole tool.

The present invention also relates to a downhole tool, such as a bridge plug tool, for use in establishing a downhole seal.

BACKGROUND TO THE INVENTION

In the oil and gas industry hydrocarbon bearing formations are accessed via drilled bores extending from the surface, with such bores typically lined with metal tubing to provide sealing and support. Many tools have been developed in the art for performing desired operations downhole within the wellbore, such as providing sealing, taking measurements, perforating and the like. One such downhole tool is the bridge plug, which is typically used to seal or isolate a region, such as a lower region, of a wellbore.

The nature of the downhole environment, the depths involved, and the desire to maintain a wellbore in efficient production with minimal interruption call for tools which are extremely robust and reliable. That is, operators must have confidence that any tooling used within a wellbore will reliably perform its desired function and will not fail while downhole, which could require remedial action such as rescuing the tool, drilling out the tool or even abandoning the wellbore, all at significant delay to production with associated financial consequences.

Many downhole tools may require to become anchored within the wellbore. Known designs, such as might be used in bridge plugs, utilise slips which are radially extended from the body of a tool to engage the inner surface of the wellbore, thus locking the tool in a fixed axial location within the wellbore. Some known slips may be mounted on a cone which is axially displaced to radially extend the slips. In prior art arrangements a slip may only be supported at the point of contact with the cone such that any forces established when the slip engages a bore wall will only be reacted through the point of engagement with the cone. This may focus significant levels of stress in both the cone and the slip which may be undesirable and establish a potential point of failure.

Also, it is desirable in many cases for downhole tools to be retrievable, requiring the ability for anchor slips to be retracted, and maintained in a retracted configuration while the tool may be retrieved from the wellbore without hindrance. Such retraction may be provided by an interengaging profile arrangement, such as a dovetail arrangement, between the slips and an actuating cone. However, such an interengaging profile may be subject to failure, such as by blockage, plastic or complete mechanical failure or the like. Further, it may also be known in the art to utilise spring return systems. However, the structural arrangements of known slip designs and the minimal available space may only permit the use of springs with relatively low spring force, which may be insufficient to achieve retraction of a slip.

Many downhole tools such as those which incorporate anchor slips require to be actuated by application of a setting force, for example an axial setting force to drive an actuating cone. Such a setting force may be provided by a separate setting tool. However, it may be undesirable to continuously apply a setting force via a setting tool to maintain a set of slips, for example, in an extended configuration. In such cases it is known to provide a locking or ratchet system which permits a setting configuration to be locked-in permitting the setting force to be removed. Many forms of ratchet system exist, and normally include a ratchet component having ratchet teeth which engage corresponding teeth in a ratchet body. As most downhole tools are generally cylindrical it is common to utilise ratchet components which are, in essence, curved segments and often these segments have minimal dimensions due to space restrictions. It is often the case, therefore, that the forces applied through the ratchet teeth when engaged are only applied over minimal areas, which may establish significant stresses through the components of the ratchet system and creating a possible failure point. Furthermore, due to the potential hold-forces involved, it may be difficult to apply the necessary release force, without damaging the ratchet components.

SUMMARY OF THE INVENTION

According to a first aspect of the present invention there is provided a downhole tool to be positioned and secured within a bore, said tool comprising:

a slip member pivotable about a pivot axis between retracted and extended configurations, the slip member defining an actuation surface and a brace surface; and a wedge member defining a wedge surface, wherein the wedge member and slip member are configured to move relative to each other such that interengagement between the wedge surface and the actuation surface causes said slip member to pivot, wherein when the slip member is in the extended configuration the actuation surface is in engagement with the wedge surface of the wedge member and the brace surface is in engagement with a support surface formed on the tool.

In use, the slip member may be moved towards the extended configuration to engage a bore wall. Accordingly, when the slip member is extended to engage a bore wall said slip member is supported via both the actuation surface and the brace surface. This may provide significant improvements over prior art arrangements in which limited support to a slip may be provided. Furthermore, providing support from both the actuation and brace surfaces may minimise any reaction forces being focussed at the pivot axis of the slip.

In some embodiments the wedge member may function as a cam member and the slip member may function as a follower member.

The actuation and brace surfaces of the slip member may be separate surfaces. For example, the actuation and brace surfaces may be aligned in different planes, that is, non co-planar. In such an arrangement the wedge surface of the wedge member and the support surface of the tool may also be aligned in different planes.

The general plane of each of the actuation and brace surfaces may define an angle of separation therebetween. In one embodiment the angle of separation may be acute. However, in other embodiments the angle of separation may be perpendicular or obtuse. The angle of separation defined between the actuation and brace surfaces may dictate the permitted angle of pivot of the slip member.

When the slip member is in a retracted position the brace surface of the slip member and the support surface of the tool may define a relief or separation therebetween. This separation may permit the slip to rotate. That is, rotation of the slip will close the relief or separation between the brace and support surfaces until full engagement is achieved. The angle of the relief or separation may define a permitted pivot or rotation angle of the slip. Accordingly, this may eliminate the risk of the slip becoming over extended which may be undesirable. For example, over extension of the slip may damage the tool, damage to the bore wall, prevent later retraction of the slip member or the like.

The slip member may define an engagement surface configured to engage a bore wall. The engagement surface may be configured as is known in the art, for example to have a curved surface to compliment the contour of a bore wall, to include serrations to assist with grip and the like. When in a fully extended configuration the slip member may be engaged over three separate surfaces, specifically the engagement surface, the actuation surface and the brace surface. Accordingly, the slip member may be robustly supported when in an operation configuration.

The engagement surface may be aligned in a different plane to that of the actuation and brace surfaces. In one embodiment the engagement, actuation and brace surfaces of the slip member may be mutually non co-planar. Such an arrangement may facilitate appropriate load sharing between both the actuation and brace surfaces of the slip member when the engagement surface is in engagement with a bore wall and forces are reacted therebetween.

The actuation and brace surfaces may be interconnected at a corner region of the slip member. The corner region may be curved. For example, the slip member may define a curved surface which interconnects the actuation and brace surfaces. The curved surface may define a rolling or bearing contact with a region of the tool during pivoting motion of the slip member. This arrangement may provide appropriate support to the slip member in the corner region and between both the actuation and brace surface during such pivoting.

The pivot axis may be provided generally in the corner region of the slip member. That is, the pivot axis location may be located generally laterally offset from a longitudinal centre line of the slip member. The longitudinal centre line may be defined as a centre line based on the centre of a region of maximum thickness of the slip member. Having an offset pivot axis may provide an increased region of the slip to be used for other reasons, for example to increase the available size of the brace surface or the like.

The slip member may be restricted to only pivotal motion to be configured in the extended configuration and engage a bore wall. In such an arrangement the slip member may be mounted within the tool in such a manner that only pivotal motion is permitted.

The slip member may be permitted to both pivot and move linearly, for example radially, to be configured in the extended configuration. That is, the slip member may be mounted within the tool in such a manner that pivotal motion of the slip is permitted, in addition to some kind of linear motion of the entire slip. The ability to be both pivoted and linearly displaced may facilitate improved compliance with a bore wall, and, for example, permit a greater extension ratio to be achieved.

The pivot axis may be defined by a shaft. The shaft may be integrally formed on the slip member. The shaft may be mounted to pivot or rotate on the tool. For example, the shaft may be mounted in one or more journal arrangements, such as bores, slots or the like formed in or on the tool. The shaft may be mounted to be moved linearly on the tool. For example, the shaft may be mounted within an elongated slot, channel or the like. The shaft may be defined by bosses formed on opposite sides of the slip. Alternatively a separate shaft may be provided and the slip member may define a journal bore which receives the shaft.

In some embodiments a shaft which defines a pivot axis of the slip member may be configured to carry minimal forces when the slip member is in an extended configuration. This may be facilitated by the presence of support provided by both the actuating and brace surfaces of the slip member. As such, the shaft may be afforded a degree of protection from excessive applied forces.

In some embodiments a shaft may be provided to retain the slip member fixed relative to the downhole tool.

The pivot axis may be defined within the structure of the slip member. For example, the pivot axis may be defined at a centre of curvature of a curved surface of the slip member, such as a curved surface which interconnects the actuation and brace surfaces of the slip member. In such an arrangement the curved surface of the slip member may in effect define a portion of a shaft.

The pivot axis of the slip member may be aligned substantially perpendicular to a longitudinal centre axis of the tool.

The pivot axis of the slip member may be aligned substantially parallel with a longitudinal centre axis of the tool.

The pivot axis of the slip member may be obliquely aligned with a longitudinal centre axis of the tool.

The wedge surface of the wedge member and actuation surface of the slip member may define complimentary surfaces, at least when the slip member is in an extended configuration. Such an arrangement may permit maximum surface area engagement of these surfaces to permit more uniform support of the slip member and to prevent an imbalanced stress distribution in either of the wedge member and the slip member.

The actuation surface of the slip member may be planar to define a substantially flat surface. The wedge surface of the wedge member may be planar to define a substantially flat surface. Having planar actuation and wedge surfaces may permit a fuller extent of the surfaces to be supported. Furthermore, having planar actuation and wedge surfaces may assist to prevent any relative movement between the slip member and the wedge member in a circumferential direction. This may assist to rotationally lock the downhole tool when the slip member is in engagement with a bore wall.

In some embodiments one or both of the actuation and wedge surfaces may be curved.

The wedge and slip members may be moved axially relative to each other to cause the slip member to pivot. The wedge and slip members may be rotationally moved relative to each other to cause the slip member to pivot.

The wedge member may be fixed and the slip member may be moveable. The slip member may be fixed and the wedge member may be moveable. Both the wedge member and slip member may be moveable.

The downhole tool may comprise a plurality of slip members. Two or more slip members may be configured similarly. The slip members may be circumferentially distributed about the tool. The slip members may be axially distributed along the tool.

The downhole tool may comprise a plurality of wedge members. The wedge members may be circumferentially and/or axially distributed about or along the tool.

The downhole tool may comprise a circumferential array of slip members. In one embodiment a circumferential array of five slip members may be provided, although an array of any suitable number may be provided. The slip members in the array may be evenly circumferentially distributed about the tool.

The downhole tool may comprise a plurality of circumferential arrays of slip members arranged axially along the tool. For example, in one embodiment two axially spaced circumferential arrays may be provided, although any suitable number of arrays may be provided. Each array of slip members may provide the individual slips to be oriented in a desired direction. For example, the slips may be provided in a direction suited to the primary loading direction. In one embodiment each array may provide the associated slips to be facing or oriented in opposing directions.

The downhole tool may comprise a wedge member configured to actuate two or more slip members. For example, a wedge member may comprise a wedge surface configured to engage two or more actuation surfaces of respective slip members. In one embodiment a wedge member may comprise more than one wedge surface, wherein each wedge surface is configured to engage an actuation surface of one or more respective slip members.

The downhole tool may comprise a plurality of wedge members each configured to engage one or more slip members. In one embodiment the downhole tool may comprise a circumferential array of slip members and a circumferential array of wedge members.

In one embodiment the downhole tool may comprise at least two axially arranged slip members and a wedge member having a wedge surface at opposite axial ends thereof, wherein each wedge surface is arranged to engage a respective axially arranged slip member.

In one embodiment the tool may comprise:

a first circumferential array of slip members;

a second circumferential array of slip members axially spaced from the first circumferential array;

a circumferential array of wedge members interposed between the first and second arrays of slip members, wherein each wedge member is configured to engage a respective slip member in each array.

In such an arrangement a single wedge member may be utilised to pivot a pair of axially spaced wedge members.

The downhole tool may comprise a slip sleeve configured to carry one or more slip members. The slip sleeve may be configured to carry a plurality of slip members in a circumferential array.

The downhole tool may comprise a plurality of slip sleeves each configured to carry one or more slip members. Each slip sleeve may be configured to carry a respective circumferential array of slip members.

One or more slip members may be pivotally mounted relative to a slip sleeve. One or more slip members may be mounted to be moved linearly relative to a slip sleeve. In one embodiment the slip sleeve may define one or more recesses, slots, channels or bores configured to receive one or more corresponding shaft members or bosses formed or provided on a slip member.

The slip sleeve may be moveable to cause an associated slip member to move relative to a wedge member to cause the slip member to pivot.

In one embodiment the slip sleeve may be stationary to hold an associated slip member such that movement of a wedge member may cause the slip member to move, for example to pivot and optionally move linearly.

The slip sleeve may define the support surface of the tool which is engaged by the brace surface of a slip member. The slip sleeve may define multiple support surfaces configured to be engaged by the brace surfaces of respective slip members.

The slip sleeve may be configured to be temporarily rigidly secured to a wedge member. Such a temporary rigid connection may prevent relative movement of a slip member and a wedge member. This may be advantageous in preventing relative movement when actuation of the slip member is not desired, such as when the downhole tool is being deployed. The rigid connection between the slip sleeve and the wedge member may be defined by a releasable connection such that relative movement between the wedge member and slip member may be permitted when required. The releasable connection may be released upon exposure to a predetermined input, such as upon application of a predetermined force. The releasable connection may be defined by a latch mechanism. The releasable connection may be defined by a frangible connection, such as a shear screw, which is configured to break or fail upon exposure to a predetermined force, for example an actuation force.

The temporary rigid connection between the slip sleeve and wedge member may be arranged to permit a greater relative movement between the wedge member and slip member in a direction to retract the slip member than in a direction to extend the slip member. In such an arrangement the additional permitted movement in the direction to retract the slip member may facilitate a separate operation. Such a separate operation may include the activation of a latch or ratchet mechanism to retain the slip member in a retracted position.

For example, in one embodiment the tool may comprise a retracted latch arrangement which is initially inactive or disengaged when the slip sleeve and wedge members are rigidly connected together, and which is capable of being activated or engaged by the additional permitted relative movement of the slip sleeve and wedge member in a direction to retract the slip member.

The slip sleeve may be provided in the form of a cage structure.

The slip sleeve may comprise at least one circumferential opening within which the slip member is located. The circumferential opening may accommodate at least a portion of a wedge member, such as a portion of the wedge member which incorporates a wedge surface. The slip sleeve may comprise a plurality of circumferential openings which each accommodates respective slip members and optionally wedge members.

The downhole tool may comprise a biasing arrangement configured to act to bias the slip member in a direction towards a retracted position. Accordingly, during extension the slip member may be moved against the biasing arrangement.

The biasing arrangement may comprise one or more springs.

The biasing arrangement may comprise an engagement structure configured to engage the slip member and apply a bias force thereto. The biasing arrangement may comprise one or more springs configured to act against the engagement structure. The engagement structure may be defined by a finger portion.

The slip sleeve may be configured to accommodate the biasing arrangement, for example accommodate an engagement structure of the biasing arrangement. In one embodiment the slip sleeve may define a longitudinal slot or channel within which the engagement structure is configured to move.

The engagement structure may be configured to engage the brace surface of the slip member. The engagement structure may engage the slip member at a location which is offset from the slip member pivot axis so as to establish a turning moment in a direction to bias the slip member to pivot in a direction towards a retracted position. In embodiments where the pivot axis of the slip member is arranged to be offset from a longitudinal centre line, for example at a corner region, the engagement structure may be capable of acting on the slip member at an increased distance from the pivot axis thus maximising the torque which may be applied.

In embodiments where a plurality of slip members are provided the biasing arrangement may comprise a plurality of engagement structures configured to engage respective slip members.

The biasing arrangement may comprise a bias sleeve or ring which includes an engagement structure which engages the slip member. The bias sleeve may comprise a plurality of engagement structures arranged to engage respective slip members. The bias sleeve may comprise a plurality of circumferentially arranged engagement structures arranged to engage a plurality of circumferentially arranged slip members. The bias sleeve may comprise a plurality of castellations which each define an engagement structure.

The bias sleeve may be generally co-axial with the slip sleeve. The bias sleeve may at least partially axially overlap the slip sleeve.

The biasing arrangement may comprise a spring or spring like structure configured to act against the bias sleeve. The spring may comprise a coil spring which may permit significant spring force, and thus bias force, to be achieved. Any suitable spring, however, may be used, such as a Bellville spring, disk spring, fluid spring or the like. The spring may be located within an annular gap defined between the slip sleeve and the bias sleeve.

The bias arrangement may comprise an adjusting assembly configured to permit adjustment of the bias force. Such an adjusting assembly may comprise a nut arrangement configured to alter compression of a spring to thus adjust the effective minimum force generated by the spring.

The downhole tool may comprise a mandrel. The wedge member may be mounted on the mandrel. In some embodiments at least a longitudinal portion or region of the mandrel may be non-circular in cross section. In one embodiment at least one peripheral segment may be defined by a planar or flat surface, wherein the wedge member is supported on said planar surface. This arrangement may permit the tool to become rotationally locked within the bore once the slip member is engaged with a bore wall.

At least a longitudinal portion or region of the mandrel may comprise a plurality of peripheral segments defining a planar surface, wherein each planar surface supports a respective wedge member. In one embodiment a longitudinal portion of the mandrel may define a polygonal cross-section, such as a pentagon, hexagon or the like.

The downhole tool may comprise an outer sleeve assembly mounted on the mandrel. The outer sleeve assembly and the mandrel may be configured to be moved relative to each other, for example axially relative to each other, to at least effect extension of the slip member. The outer sleeve assembly and mandrel may be configured to be moved relative to each other by use of a setting tool.

The outer sleeve assembly may incorporate a slip member. The outer sleeve assembly may incorporate a slip sleeve. The outer sleeve assembly may incorporate a biasing arrangement which may include a bias sleeve and spring.

Portions of the outer sleeve assembly may be configured to permit axial extension and/or contraction of the sleeve assembly. This permitted axial extension and/or contraction may permit, for example, different circumferential arrays of slip members to be contained within the outer sleeve assembly and become activated to pivot.

The downhole tool may comprise a sealing assembly configured to be radially extended to establish a seal between the tool and a bore wall. The downhole tool may be configured as a bridge plug, packer, liner hanger, bore plug or the like.

The downhole tool may be configured to both become anchored within the bore by use of the slip member, and provide a seal in the bore by use of the sealing assembly.

The seal assembly may comprise a packer element or elements.

The seal assembly may comprise a deformable element or elements configured to be deformed to become radially extended.

The seal assembly may comprise an inflatable structure.

The seal assembly may comprise a swellable structure.

The seal assembly may comprise a metallic seal assembly.

The seal assembly may comprise an annular structure configured to be axially compressed to effect radial extension.

In one embodiment the downhole tool may be configured such that a common actuation event may be used to actuate both the slip member and the sealing arrangement. In some embodiments the slip member and sealing arrangement may be activated simultaneously. In other embodiments the slip member and sealing arrangement may be activated sequentially. For example, the downhole tool may be arranged such that during an activation sequence the slip member is first activated to engage a bore wall to anchor the tool within a bore, and then the sealing arrangement is activated to establish a seal.

The outer sleeve assembly may incorporate the sealing arrangement.

The downhole tool may comprise a locking arrangement configured to lock the slip member in an extended configuration. The locking arrangement may be releasable to permit the slip member to be retracted. The locking arrangement may also function in combination with a sealing assembly, for example to lock the sealing assembly in an activated configuration.

The downhole tool may comprise a ratchet mechanism configured to prevent retraction of the slip member during extension thereof and to lock the slip member in an extended configuration. The ratchet mechanism may be configured to permit relative movement between the slip member and wedge member in a direction to effect extension of the slip member, and restrict relative movement of the slip member and wedge member in a direction to effect retraction of the slip member. The ratchet mechanism may permit a setting force to be used to cause relative movement of the slip member and wedge member to cause extension of the slip member and retain the slip member in an extended position even when the setting force has been removed.

The ratchet mechanism may be configured to prevent deactivation of a sealing assembly, for example when a setting force is removed.

The ratchet mechanism may be releasable to permit retraction of the slip member when desired. The ratchet mechanism may be releasable to permit retraction of the sealing assembly when desired.

The ratchet mechanism may comprise:

a reference member comprising a surface ratchet profile;

a ratchet mandrel sleeve arranged coaxially with the reference member and defining a plurality of circumferentially distributed windows; and a circumferential ratchet assembly arranged generally coaxially with the ratchet mandrel sleeve such that the ratchet mandrel sleeve is interposed between the circumferential ratchet assembly and the reference member.

The circumferential ratchet assembly may comprise a plurality of circumferentially distributed ratchet members or projections each comprising a surface ratchet profile and arranged to extend through a respective window in the ratchet mandrel to permit relative engagement between the ratchet profiles of the reference member and the ratchet members.

The ratchet profiles of the reference member and the ratchet members of the ratchet assembly may permit movement of the ratchet mandrel sleeve and ratchet assembly relative to the reference member in a first direction, and resist relative motion in an opposite second direction.

The first direction may define a direction in which the slip member may be caused to extend, and the second direction may define a direction in which the slip member may be caused to retract.

In such an arrangement of a ratchet mechanism a significant circumferential degree of engagement between respective ratchet profiles may be achieved. This may establish a greater area over which the forces may be transmitted between the reference member and ratchet assembly, thus minimising the resulting stresses and strains applied within the ratchet mechanism.

The reference member may comprise a circumferentially extending surface ratchet profile.

The reference member may comprise a mandrel of the tool. For example, the mandrel may comprise the surface ratchet profile.

The circumferential ratchet assembly may form part of or be mounted on a sleeve assembly of the tool. In this way, the ratchet mechanism may permit relative movement of the outer sleeve assembly and mandrel in a direction to cause the slip member to extend, and restrict relative movement of the outer sleeve assembly and mandrel in a direction to retract the slip member.

In one embodiment the ratchet mandrel sleeve and circumferential ratchet assembly may be located radially outwardly or externally of the reference member. In other embodiments the ratchet mandrel sleeve and circumferential ratchet assembly may be located radially inwardly or internally of the reference member.

The respective ratchet profiles of the reference member and the ratchet assembly may be arranged to slide across each other when the reference member and ratchet assembly are moved relative to each other in the first direction. The respective profiles may be arranged to become locked together when the reference member and ratchet assembly are moved relative to each other in the second direction.

The circumferential ratchet assembly may be configured to be radially extended or displaced to permit the ratchet profiles to slide across each other when the reference member and ratchet assembly are moved relative to each other in the first direction. In this respect the respective ratchet profiles may define a plurality of ramped structures such that interengagement of the ramped structures during relative movement in the first direction causes the ratchet assembly to be radially extended.

It should be noted that in embodiments where the circumferential ratchet assembly is located externally of the reference member, the ratchet assembly may be arranged to be extended radially outwardly. However, in embodiments where the circumferential ratchet assembly is located internally of the reference member the ratchet assembly may be arranged to be extended radially inwardly.

The circumferential ratchet assembly may be defined by a sleeve structure, such as a unitary sleeve structure which carries or is integrally formed with the individual ratchet members or projections. In such an arrangement the sleeve structure may be circumferentially split to permit said sleeve structure to be radially extended. The circumferential split may be defined by a longitudinally extending split. In such an arrangement the sleeve structure may be generally C-shaped in cross-section. The circumferential split may be defined by a spiral split which extends both longitudinally and circumferentially of the sleeve structure.

The circumferential ratchet assembly may be defined by a plurality of individual ratchet members arranged circumferentially relative to the reference member. The individual ratchet members may be secured together, for example via an annular band structure, such as a spring member or the like.

The ratchet mechanism may comprise a load arrangement configured to apply a load on the circumferential ratchet assembly to prevent radial or circumferential extension of said assembly when the reference member and ratchet assembly are set to move relative to each other in the second direction, that is a direction to cause retraction of the slip member. By preventing the ratchet assembly from extending radially or circumferentially the ratchet profiles on the ratchet assembly and the reference member may be permanently engaged and thus prevent relative movement of the ratchet assembly and reference member. In such a configuration the slip member may be locked in an extended configuration.

The load arrangement may comprise a load ring. The load ring may define a tapered surface configured to engage a tapered surface on the ratchet assembly. The respective tapered surfaces may be arranged such that any relative axial movement in the second direction will apply a radial force on the ratchet assembly thus preventing circumferential extension thereof.

Each ratchet member of the ratchet assembly may define a tapered surface which is engaged by the load ring.

The load arrangement may be configured to be deactivated to prevent any load being applied on the ratchet assembly. This may be required when it is desired to release the ratchet mechanism and permit the slip member to be retracted.

The load arrangement may comprise a release ring which in a first configuration permits the load ring to apply a load on the ratchet assembly, and in a second configuration prevents or reduces the ability of the load ring to apply a load on the ratchet assembly. The release ring may be configured to be radially or circumferentially extended, wherein when in an extended position the release ring permits the load ring to apply a load on the ratchet assembly, and when in a retracted position the release ring prevents or minimises the ability of the load ring to apply a load on the ratchet assembly.

The release ring may be circumferentially split to permit radial extension thereof. The release ring may comprise or define a longitudinal split, for example.

The ratchet mechanism may comprise a release ring support which is moveable between supporting and de-supporting configurations. When in the supporting configuration the release ring support supports the release ring in an extended configuration and thus permits the load ring to apply a load on the ratchet assembly. When in the de-supporting configuration the release ring support does not provide support to the release ring which may be retracted and thus prevents or minimises the ability of the load ring to apply a force on the ratchet assembly.

The ratchet mandrel sleeve may be configured to displace, for example by pushing, the ratchet assembly relative to the reference member in the first direction, that is the direction in which the slip member is caused to extend.

The ratchet mandrel sleeve may be configured to be moved relative to the ratchet assembly in an opposite direction. This relative movement may be achieved by providing the windows in the ratchet mandrel sleeve to have a greater longitudinal width or extent than the ratchet members of the ratchet assembly. The ratchet mandrel sleeve may be moved in the opposite direction to initiate deactivation of the ratchet mechanism, for example when it is desired to permit retraction of the slip member. The ratchet mandrel sleeve may be initially prevented from moving in the opposite direction relative to the ratchet assembly. For example, the ratchet mandrel sleeve may be temporarily locked relative to the ratchet assembly, for example via a shear screw arrangement. When relative movement is required the ratchet mandrel sleeve may be released, for example by applying a sufficient force to shear any locking shear screws or the like.

The ratchet mandrel sleeve may define the release ring support. In such an arrangement when the ratchet mandrel sleeve is operated to displace the ratchet assembly relative to the reference member in a direction in which the slip member is caused to extend, the ratchet mandrel sleeve may be in a position to support the release ring. As such, the slip member may be locked in an extended configuration. Further, when the ratchet mandrel sleeve is operated to move in an opposite direction relative to the ratchet assembly the ratchet mandrel sleeve may be moved to a position in which the release ring is de-supported. This may facilitate release of the ratchet assembly relative to the reference member, which may facilitate subsequent retraction of the slip member.

The ratchet assembly may comprise multiple arrays of circumferentially distributed ratchet members, and the ratchet mandrel sleeve may correspond and as such may comprise or define multiple arrays of circumferentially distributed windows arranged to accommodate the respective ratchet members.

The ratchet mandrel sleeve may be configured to disengage the respective ratchet profiles of the ratchet assembly and the reference member to permit relative movement of the ratchet assembly and the reference member to permit the slip member to be retracted. The ratchet mandrel sleeve may be configured to be moved relative to the ratchet assembly to disengage the respective ratchet profiles.

The ratchet mandrel sleeve may define a ramp structure configured to engage the ratchet assembly and cause said ratchet assembly to be radially extended to effect disengagement of the ratchet profiles. The ratchet assembly, for example the ratchet members, may define a corresponding ramp structure.

The ratchet mandrel sleeve may be configured to be moved to simultaneously or sequentially de-support the release ring and engage the ratchet assembly to cause said ratchet assembly to be radially extended.

Each window of the ratchet mandrel sleeve may define a ramp structure configured to engage a respective ratchet member of the ratchet assembly. This arrangement may permit a more uniform radial extension of the ratchet sleeve which may facilitate more reliable release of the ratchet profiles. Furthermore, such an arrangement may provide an increased load bearing area to effect release of the ratchet mechanism. This may minimise the risk of damage within the ratchet mechanism.

The ratchet mechanism may provide a permanent ratchet assembly configured to permanently lock or secure the downhole tool following complete retraction of the slip member.

According to a second aspect of the present invention there is provided a method of anchoring a tool within a bore, comprising:

locating a tool within a bore, wherein the tool comprises a slip member and a wedge member;

engaging a wedge surface of the wedge member with an actuation surface of the slip member to cause said slip member to pivot and extend to engage a bore wall; and engaging a brace surface of the slip member with a support surface on the tool when the slip member is in the extended configuration.

The method according to the second aspect may comprise use of the tool according to the first aspect.

According to a third aspect of the present invention there is provided a ratchet mechanism, comprising:

a reference member comprising a surface ratchet profile;

a ratchet mandrel sleeve arranged coaxially with the reference member and defining a plurality of circumferentially distributed windows; and a circumferential ratchet assembly arranged generally coaxially with the ratchet mandrel sleeve such that the ratchet mandrel sleeve is interposed between the circumferential ratchet assembly and the reference member, the circumferential ratchet assembly comprising a plurality of circumferentially distributed ratchet members or projections each comprising a surface ratchet profile and arranged to extend through a respective window in the ratchet mandrel to permit relative engagement between the ratchet profiles of the reference member and the ratchet members, wherein the ratchet profiles permit movement of the ratchet mandrel sleeve and ratchet assembly relative to the reference member in a first direction, and resist relative motion in an opposite second direction.

The ratchet mechanism may be configured for use within a downhole tool.

Features defined in relation to the ratchet mechanism associated with the first aspect above may apply to the ratchet mechanism according to the third aspect.

According to a fourth aspect of the present invention there is provided a downhole tool, comprising:

a radially extendable seal; and a slip arrangement comprising:

a slip member pivotable about a pivot axis between retracted and extended configurations to selectively engage a bore wall, the slip member defining an actuation surface and a brace surface; and a wedge member defining a wedge surface, wherein the wedge member and slip member are configured to move relative to each other such that interengagement between the wedge surface and the actuation surface causes said slip member to pivot, wherein when the slip member is in the extended configuration the actuation surface is in engagement with the wedge surface of the wedge member and the brace surface is in engagement with a support surface formed on the tool.

The downhole tool may comprise a ratchet mechanism, such as that defined in relation to the third aspect.

The downhole tool may define a bridge plug, packer, or the like.

According to a fifth aspect of the present invention there is provided a downhole tool, comprising:

a radially extendable seal; and a ratchet mechanism, comprising:

a reference member comprising a surface ratchet profile;

a ratchet mandrel sleeve arranged coaxially with the reference member and defining a plurality of circumferentially distributed windows; and a circumferential ratchet assembly arranged generally coaxially with the ratchet mandrel sleeve such that the ratchet mandrel sleeve is interposed between the ratchet sleeve and the reference member, the circumferential ratchet assembly comprising a plurality of circumferentially distributed ratchet members or projections each comprising a surface ratchet profile and arranged to extend through a respective window in the ratchet mandrel to permit relative engagement between the ratchet profiles of the reference member and the ratchet member, wherein the ratchet profiles permit movement of the ratchet mandrel sleeve and ratchet assembly relative to the reference member in a first direction, and resist relative motion in an opposite second direction.

The downhole tool may comprise a slip arrangement configured to anchor the tool within a bore.

The downhole tool may define a bridge plug, packer, or the like.

According to a sixth aspect of the present invention there is provided a downhole tool to be positioned and secured within a bore, said tool comprising:

a plurality of slip members arranged in a circumferential array and each being pivotable about a pivot axis between retracted and extended configurations to selectively engage a bore wall; and a biasing ring arranged to engage each slip member in the array to bias said slip members towards a retracted configuration.

The tool may comprise a spring member configured to act against the biasing ring to provide a biasing force.

The biasing ring may comprise a plurality of castellations configured to engage a respective slip member.

Features defined in relation to the tool according to the first aspect may be applied to the tool according to the sixth aspect.

According to a seventh aspect of the present invention there is provided a downhole tool to be positioned and secured within a bore, said tool comprising:

a mandrel having a portion which is non-circular in cross section and includes at least one peripheral segment which is defined by a planar surface a wedge member mounted on said planar surface; and a slip member configured to be extended by the wedge member to engage a bore wall.

This arrangement may permit the tool to become rotationally locked within the bore once the slip member is engaged with a bore wall.

Features defined in relation to the tool according to the first aspect may be applied to the tool according to the seventh aspect.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figures 1, 2A, 3A, 4A:
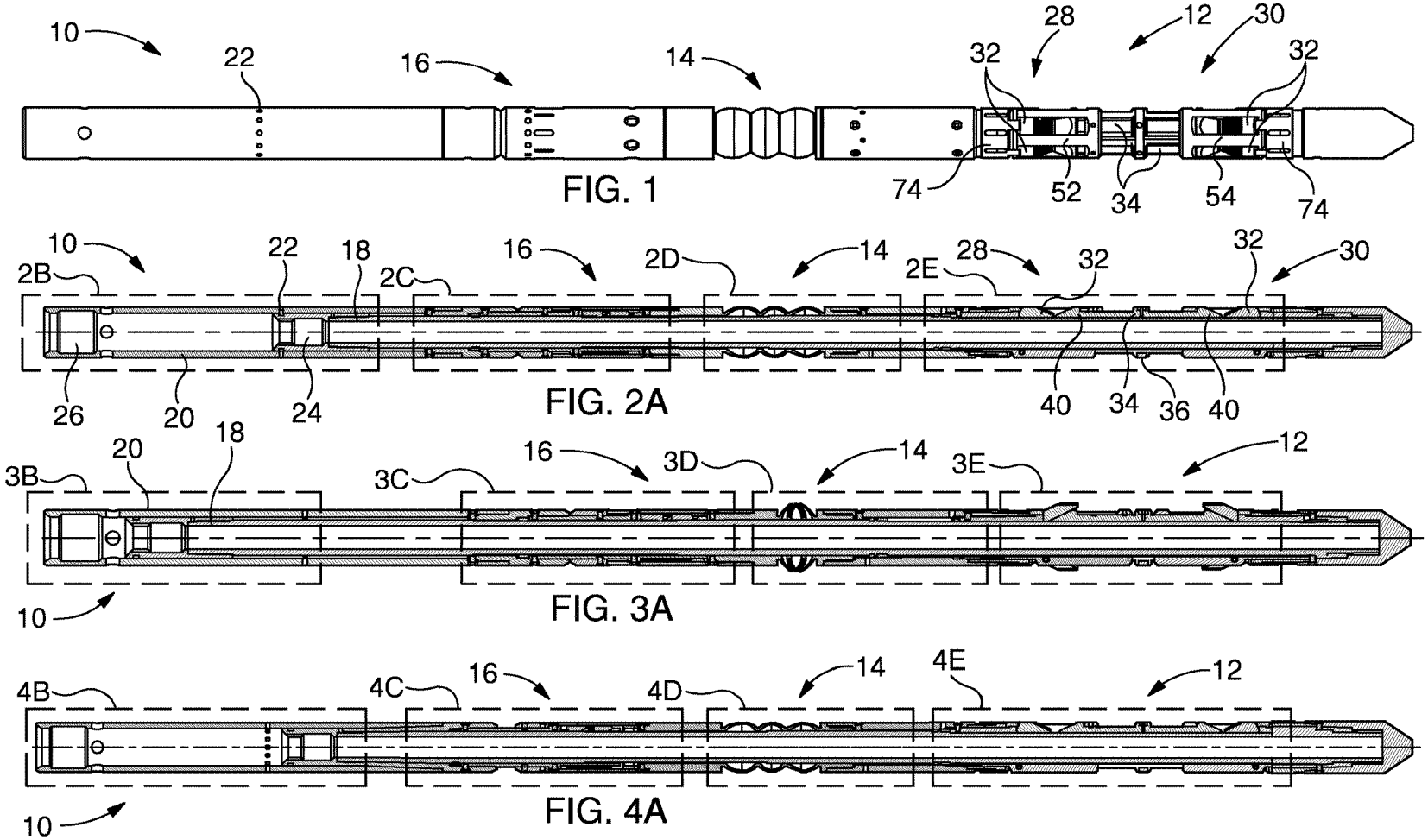
FIG. 1 illustrates a downhole tool in accordance with an embodiment of the present invention.
FIG. 2A is a cross-sectional illustration of the tool of FIG. 1 shown in a deployment configuration.
FIG. 3A is a cross-sectional illustration of the tool in FIG. 1 shown in an activated configuration.
FIG. 4A is a cross-sectional illustration of the tool of FIG. 1 shown in a retrievable configuration.

A downhole tool, generally identified by reference numeral 10, in accordance with an embodiment of the present invention is illustrated in FIG. 1. In the present embodiment the tool is a bridge plug tool and is configured for providing isolation within a bore, such as a wellbore associated with the extraction of hydrocarbons from a subterranean formation. However, it should be understood that the tool may define any suitable tool, such as a packer tool, and may be used in any bore, such as may be defined by, for example, a pipeline. Furthermore, although the following description provides details of individual features of the tool 10, it should be understood that such features may be utilised in isolation from each other, and that various aspects of the present invention may be directed to such features in isolation.

The tool 10 comprises a slip arrangement 12 which in use is configured to selectively anchor the tool 10 within a bore (not shown). The tool 10 further comprises a sealing arrangement 14 which in use is configured to establish an annular seal between the tool 10 and a bore wall (not shown). Further, the tool 10 comprises a ratchet mechanism 16 which is arranged to retain one or both of the slip arrangement 12 and seal arrangement 14 in extended configurations until such time as it might be desired to permit retraction of one or both of the slip arrangement 12 and sealing arrangement 14. Aspects of the present invention may relate to each of the slip arrangement 12, sealing arrangement 14 and ratchet arrangement 16, in isolation from each other, or in combinations of at least two of these.

A longitudinal cross-sectional view of the tool 10 is illustrated in FIG. 2A, wherein the tool 10 is shown in a deployment configuration which is suitable for deploying the tool 10 into a bore with the slip and seal arrangements 12, 14 retracted. FIGS. 2B to 2E provide enlarged views of regions of the tool 10 identified by references 2B to 2E, respectively, in the configuration of FIG. 2A.

A further longitudinal cross-sectional view of the tool 10 is illustrated in FIG. 3A, wherein the tool 10 is shown in an activated configuration in which both the slip and seal arrangements 12, 14 are extended and the ratchet arrangement 16 is operating to retain the slip and seal arrangements 12, 14 in the extended configuration. FIGS. 3B to 3E provide enlarged views of regions of the tool 10 identified by references 3B to 3E, respectively, in the configuration of FIG. 3A.

FIG. 4A is another longitudinal cross-sectional view of the tool 10 shown in a retrievable configuration in which the ratchet arrangement 16 has been deactivated and the slip and seal arrangements 12, 14 have been retracted such that the tool 10 may be retrieved from the bore. FIGS. 4B to 4E provide enlarged views of regions of the tool 10 identified by references 4B to 4E, respectively, in the configuration of FIG. 4A.

In the following description the features and function of the tool 10 in the various configurations will be presented. Throughout the description reference will be made to upper and lower regions or directions. It should be noted that the orientation of such directional references are assumed with the tool located within a bore. For clarity, the upper side of the tool or any illustrated region thereof is assumed to be located in the left hand side of each drawing, and the lower side is located in the right side of each drawing.

Figure 2B:
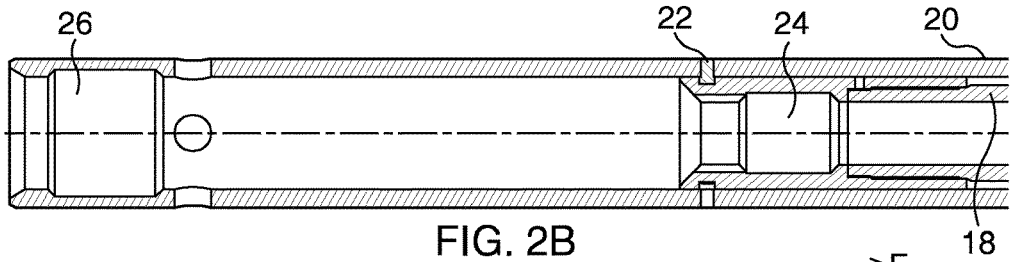
FIGS. 2B to 2E provide enlarged views of regions identified by references 2B to 2E, respectively, of the tool shown in cross-section in FIG. 2A.
Figure 2C:
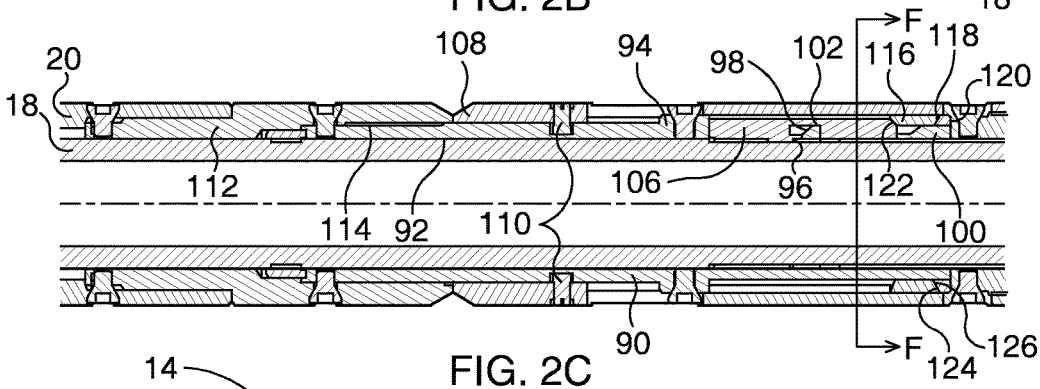
Figure 2D:
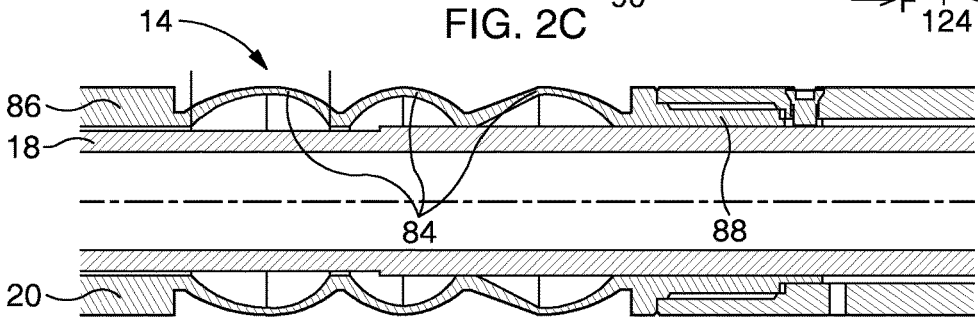
Figure 2E:
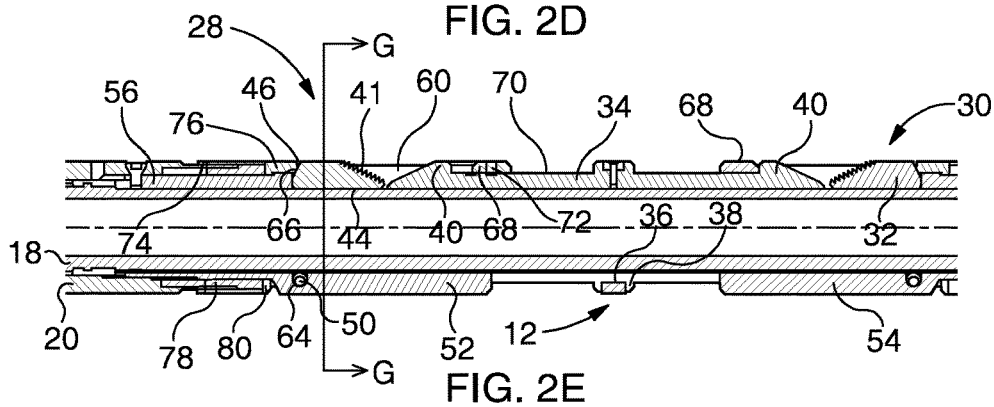
Figure 2F:
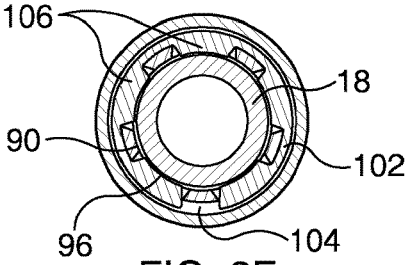
FIG. 2F provides a lateral sectional view through line F-F in FIG. 2C.
Figure 2G:
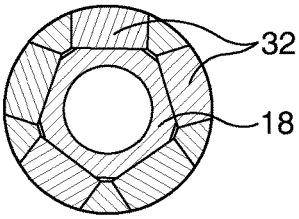
FIG. 2G provides a lateral sectional view through line G-G in FIG. 2E.

Reference is initially made to FIG. 2A, and the enlarged views in FIGS. 2B to 2E, and also the lateral cross-sections of FIGS. 2F and 2G. It should be noted that the description that follows generally makes continuous reference to FIGS. 2A to 2G. However, various illustrations of individual components of the tool 10 are illustrated in FIGS. 5 to 12, reference to which may additionally be made.

The tool 10 comprises an inner mandrel 18 which supports an outer sleeve assembly 20. As will be described in further detail below, the mandrel 18 and sleeve assembly 20 are configured to be moved axially relative to each other to reconfigure the tool 10 between retracted and extended configurations. In this respect, the mandrel 18 and outer sleeve assembly 20 are permanently secured together at a lower end of the tool 10 such that any relative movement between said mandrel 18 and sleeve assembly 20 may result in appropriate actuation of the various components and arrangements of the tool 10.

In the illustrated deployment configuration, however, the mandrel 18 and outer sleeve assembly are initially secured together via a plurality of shear screws 22 to prevent inadvertent relative movement and possible early actuation of the slip and seal arrangements 12, 14. When the tool 10 has been deployed to the required location in the bore an axial force may be applied between the mandrel 18 and outer sleeve assembly 20 to cause the screws 22 to shear and thus permit relative movement therebetween. In this respect the force and subsequent relative movement between the mandrel 18 and outer sleeve assembly 20 may be provided by a setting tool (not shown). The upper ends of the mandrel 18 and outer sleeve assembly 20 define respective profiles 24, 26 to permit engagement with a setting tool.

The slip arrangement 12, which is most clearly illustrated in FIG. 2E and which is incorporated within the outer sleeve assembly 20 includes upper and lower circumferential arrays 28, 30 of pivoting slip members 32, and a single circumferential array of wedge members 34 interposed between the slip member arrays 28, 30. In the present embodiment five evenly distributed slip members 32 are provided in each array 28, 30, and similarly five evenly distributed wedge members 34 are provided and are circumferentially aligned with respective pairs of slip members 32 in the slip arrays 28, 30.

The mandrel 18 at the region of the slip arrangement 12 is pentagonal in cross-section, as illustrated in FIG. 2G, which is a sectional view through line G-G in FIG. 2E. The slip members 32 and wedge members 34 are arranged so as to be supported on respective planar or flat regions of the pentagonal portion of the mandrel 18. Further, the wedge members 34 are secured together via an annular band 36 which is received within a central channel 38 in each wedge member 34. The annular band 36 functions to retain the wedge members 34 in engagement with the mandrel 18 and also to maintain the wedge members 34 in axial alignment with each other.

Each wedge member 34 includes a wedge profile 40 at opposing ends thereof. As will be described in further detail below, the slip members 32 are displaced relative to the wedge members 34 so as to force the slip members 32 over the wedge profiles 40 of respective wedge members 34 in order to cause the slip members to pivot towards an extended position. Each slip member 32 includes an engagement surface 41 which engages a bore wall in a gripping manner. Each engagement surface 41 includes serrations or teeth to assist with gripping.

Figure 5:
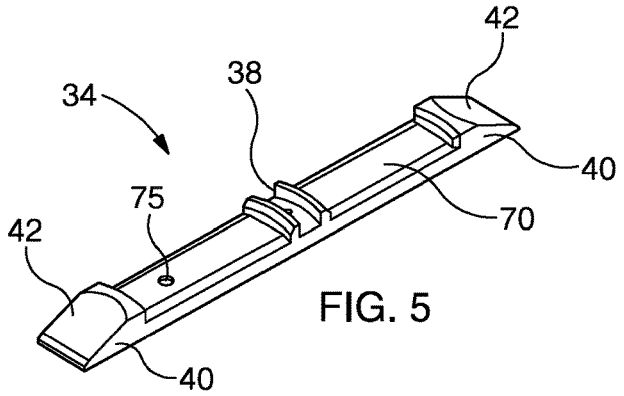
FIG. 5 is a perspective view of a wedge member of the tool of FIG. 1.
Figure 6A:
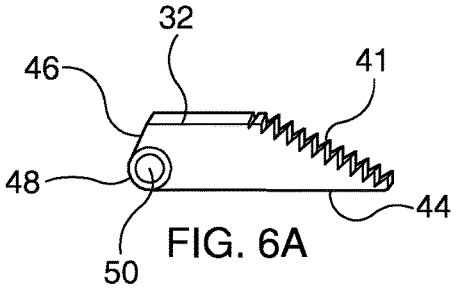
FIGS. 6A and 6B provide respective views of a slip member of the tool of FIG. 1.
Figure 6B:
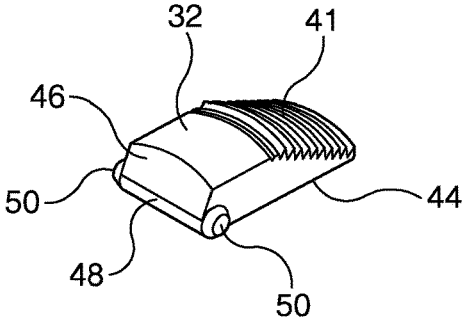

A perspective view of a wedge member 34 is illustrated in FIG. 5, and alternative views of a slip member 32 are provided in FIGS. 6A and 6B, reference to which is additionally made. As described above, each wedge member 34 comprises opposing wedge profiles 40 and in the present embodiment each wedge profile 40 defines a planar wedge surface 42. Also, each slip member 32 comprises a lower planar actuation surface 44. In use, the wedge surface 42 of each wedge profile 40 becomes engaged with the actuation surface 44 of a slip member 32 to cause the slip member to pivot towards an extended configuration. Providing both the wedge and actuation surfaces 42, 44 to be planar facilitates a larger support surface area between a slip member 32 and wedge member 34 to be achieved, thus permitting a more even force distribution when in use.

Each slip member 32 also defines a rear brace surface 46. As will be described in further detail below, the brace surface 46 of a slip member 32 is configured to become engaged with a support surface on the tool 10 when the slip member 32 is pivoted towards an extended position. Accordingly, when in an extended position a slip member 32 will be supported across both the actuation and brace surfaces 44, 46 thus establishing significantly improved support to the slip member 32 when in engagement with a bore wall and thus exposed to significant forces.

In the present embodiment the actuation and brace surfaces 44, 46 define an angle of separation therebetween, specifically an acute angle of separation. This angle of separation dictates the permitted pivot motion of a slip member 32 before the brace surface 46 becomes engaged with a support surface on the tool. Further, the actuation and brace surfaces 44, 46 are interconnected at a lower corner region of the slip member 32. More specifically, the actuation and brace surfaces 44, 46 are interconnected by a curved corner surface 48. This curved surface 48 defines a rolling engagement with the mandrel 18 during pivoting motion of the slip member 32. This may provide appropriate support to the slip member 32 during such pivoting motion.

Each slip member comprises a pair of bosses 50 (best illustrated in FIGS. 6A and 6B) which extend from opposite sides of the corner region of the slip member 32 and are used to permit the slip member 32 to be pivotally mounted on the tool. The bosses 50 define a pivot axis of the slip member 32 which is laterally offset from a longitudinal centre line of the slip member 32. Furthermore, the pivot axis defined by the bosses 50 coincides with a centre of radius of curvature of the curved corner surface 48.

The slip members 32 of each array 28, 30 are mounted in respective upper and lower slip sleeves 52, 54 which are mounted on the mandrel 18. The slip sleeves 52, 54 are generally configured similarly and as such the form and function of the upper slip sleeve 52 will be described and it should be understood that the lower slip sleeve 54 generally corresponds.

Figure 7:
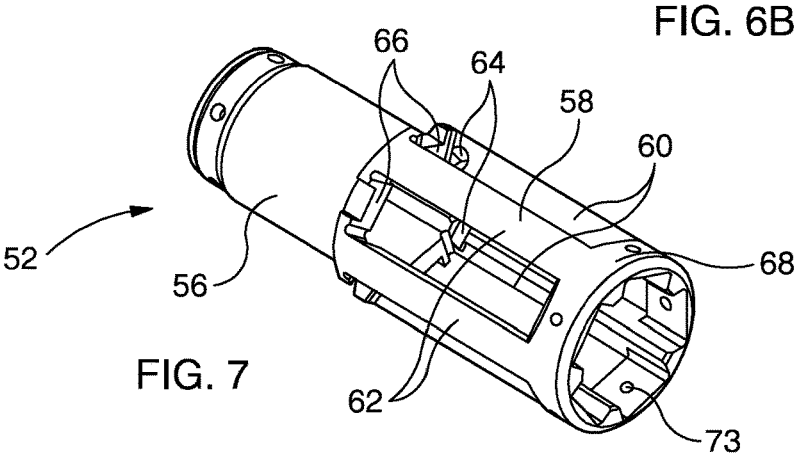
FIG. 7 is a perspective view of a slip sleeve of the tool of FIG. 1.

A perspective view of the upper slip sleeve 52 is illustrated in FIG. 7, reference to which is additionally made. The slip sleeve 52 comprises an upper cylindrical portion 56 and a lower cage portion 58 which includes a plurality of circumferentially distributed elongate windows 60 defined between elongate ribs 62. A slip member 32 is mounted in each window 60 (the slips 32 are not shown in FIG. 7 for clarity). Specifically, the bosses 50 (FIGS. 6A and 6B) of each slip member 32 are mounted in recesses or slots 64 formed in the inner surfaces of the elongate ribs 62. As such, once the slips 32 are secured within respective windows 60 with the bosses 50 located in the recesses 64, and the slip sleeve 52 is located on the mandrel, the slips 32 become pivotally captivated between said slip sleeve 52 and mandrel 18.

In the embodiment shown the recesses 64 are of a dimension to only permit pivoting motion of the associated slip members 32. However, in other embodiment the recesses 64 may be elongate such that the respective slip members 32 may be both pivoted and moved radially relative to the tool. Such an arrangement may increase the available expansion of the slip members 32, and may, for example, improve compliance with a bore wall.

At one end of each window 60 there is defined a support surface 66 which is provided to be engaged by the brace surface 46 of a respective slip member 32 when pivoted towards and extended position.

A wedge profile 40 of a wedge member 34 is also located within each window 60 of the slip sleeve 52, wherein the slip sleeve comprises a guide ring portion 68 which engages a guide surface 70 (see, for example, FIGS. 2E and 5) of each wedge member 34. When the tool 10 is in the currently described deployment configuration the guide ring portion 68 of the upper slip sleeve 52 is secured to each wedge member 34 via respective shear screws 72 (via respective bores 73, 75 in the slip sleeve 52 and wedge members 34) which functions to initially rigidly secure the slip sleeve 52 and associated slip members 32 relative to the wedge members 34 to thus prevent actuation of the slip members 32 when in this deployment configuration. When extension of the slip members 32 is required a suitable setting force may be provided to cause the screws 72 to shear and permit the slip sleeves 52, 54 and carried slip members 32 to move relative to the wedge members 34 and cause the slip members 32 to pivot towards an extended position, as described in more detail below.

Figure 8:
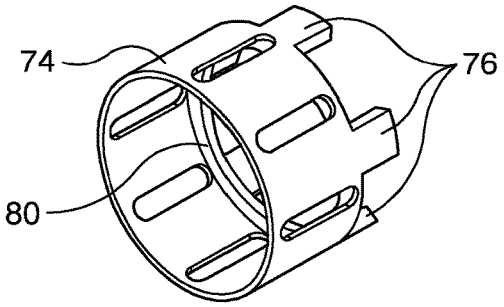
FIG. 8 is a perspective view of a biasing sleeve of the tool of FIG. 1.

The slip arrangement 12 further comprises a biasing assembly which in use provides a biasing force on each slip member 32 within a slip array 28, 30 to bias the slip members 32 towards a retracted configuration. The biasing assembly comprises separate arrangements for each of the upper and lower slip arrays 28, 30, wherein each arrangement is similarly configured. As such, only the upper biasing arrangement which acts on the upper slip array 28 will be described and it should be understood that the lower biasing arrangement corresponds. The upper biasing arrangement comprises a biasing sleeve 74 which is mounted externally of and coaxially with the cylindrical portion 56 of the slip sleeve 52. A perspective view of the biasing sleeve 74 is shown in FIG. 8, reference to which is additionally made.

The biasing sleeve 74 comprises a plurality of castellations 76 which are each configured to engage a brace surface 46 of each slip member 32 in the upper array 28. A coil spring 78 (FIG. 2E) is located within an annular gap between the biasing sleeve 74 and the cylindrical portion 56 of the slip sleeve 52 and acts against the biasing sleeve 74, specifically against an annular lip 80 of the biasing sleeve 74 to force said sleeve in a direction to press the castellations 76 against the brace surfaces 46 of the respective slip members 32.

As illustrated in FIG. 2E, for example, each castellation 76 engages the brace surface 46 of a slip member 32 at a location which is offset from the pivot axis of said slip member 32 such that a turning moment is established at the pivot axis. The resulting torque acts in a direction to move or bias the slip member 32 in a direction towards a retracted position. As noted above, the pivot axis of each slip member 32 is located in a corner region and is thus offset from a longitudinal centre line of the slip member 32. As such, the castellations 76 may act on respective brace surfaces 46 at a maximum distance from the pivot axis, thus maximising the applied torque. This, in combination with the ability to utilise a coiled spring 80, may permit a significant biasing force to be achieved.

The sealing arrangement 14 when in a retracted configuration is shown clearly in FIG. 2D. The sealing assembly 14, which is incorporated within the outer sleeve assembly 20, comprises a plurality of axially distributed sealing segments 84 arranged between upper and lower support cylinders 86, 88. As will be described in detail below, axial compression of the sealing segments 84 by displacing the support cylinders 86, 88 towards each other causes each segment 84 to extend radially outwardly and sealingly engage a bore wall.

The ratchet arrangement 16, which is shown clearly in FIG. 2C, will now be described. Portions of the ratchet assembly are provided in both the mandrel 18 and outer sleeve assembly 20.

Figure 9:
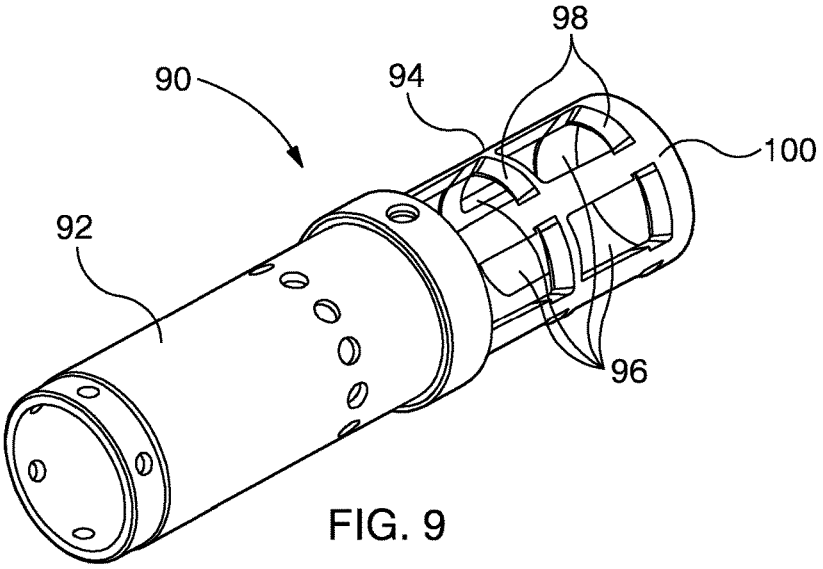
FIG. 9 is a perspective view of a ratchet mandrel sleeve of the tool of FIG. 1.

The ratchet arrangement 16 comprises a ratchet mandrel sleeve 90 which is mounted coaxially on the mandrel 18. A perspective view of the ratchet mandrel sleeve 90 is shown in FIG. 9, reference to which is additionally made. The ratchet mandrel sleeve 90 includes an upper cylindrical portion 92 and a lower cage portion 94. The cage portion 94 comprises two axially spaced circumferential arrays of windows 96, wherein the lower edge of each window 96 includes a ramp structure 98, and the lowermost end of the cage portion 94 is defined by a support ring 100.

The region of the mandrel 18 on which the ratchet arrangement 16 is located includes a ratchet tooth profile. As such, the mandrel 18 may function as a reference member of the ratchet arrangement 16.

Figure 10:
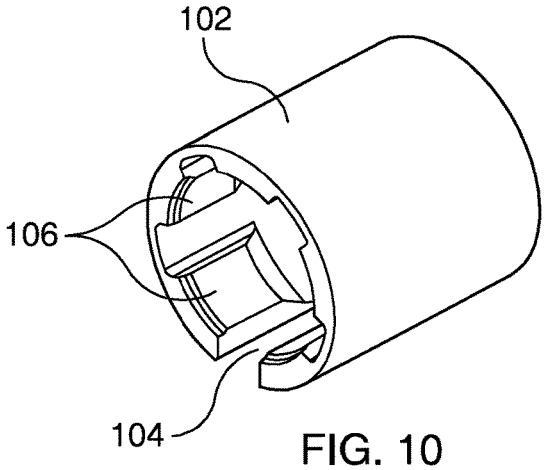
FIG. 10 is a perspective view of a ratchet sleeve of the tool of FIG. 1.

The ratchet arrangement 16 further comprises a circumferential ratchet assembly, which in this embodiment is provided in the form of a sleeve 102 and which is mounted coaxially with the lower cage portion 94 of the ratchet mandrel 90. A perspective view of the ratchet sleeve 102 is shown in FIG. 10, reference to which is now additionally made. The ratchet sleeve 102 defines a longitudinal split 104 and comprises a plurality of inwardly extending ratchet members or projections 106 which each comprise a ratchet tooth profile on their inner surfaces, wherein the projections 106 extend through respective windows 96 in the lower cage portion 94 of the ratchet mandrel 90 to permit the ratchet profiles of the projections 106 and mandrel 18 to become engaged. A lateral cross-section through line F-F of FIG. 2C is shown in FIG. 2F, reference to which is additionally made, wherein the projections 106 extending through the windows 96 is clearly illustrated. In this respect, the present ratchet arrangement 16 permits engagement between ratchet profiles over a significant circumferential extent of the mandrel 18, thus permitting improved distribution of forces.

As will be described in further detail below, respective engagement and disengagement of the ratchet profiles may permit the ratchet arrangement 16 to selectively lock the mandrel 18 relative to the outer sleeve assembly 20. Specifically, one particular function of the ratchet arrangement 16 is to permit relative movement of the mandrel 18 and sleeve assembly 20 when it is desired to extend both the slip and sealing arrangements 12, 14, and prevent inadvertent retraction of the slip and sealing arrangements 12, 14.

The ratchet arrangement 16 further comprises an outer ratchet guide sleeve 108 which is initially secured to the ratchet mandrel 90, specifically the cylindrical portion 92 of the ratchet mandrel 90, via a plurality of shear screws 110. An upper end of the cylindrical portion 92 of the ratchet mandrel 90 is secured to an upper portion 112 of the outer sleeve assembly 20 in a rigid manner via a threaded arrangement 114. As will be described in further detail below, an axial separating force applied between the upper sleeve portion 112 and the ratchet guide sleeve 108 may cause the shear screws 110 to shear and permit the upper sleeve portion 112 to pull the ratchet mandrel sleeve 90 upwardly relative to the mandrel 18. Such relative upward movement may permit the ratchet sleeve 102 to be disengaged from the mandrel 18 and thus allow the slip and sealing arrangements 12, 14 to be retracted.

Figure 11:
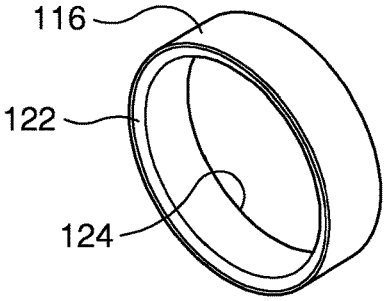
FIG. 11 is a perspective view of a load ring of the tool of FIG. 1.
Figure 12:
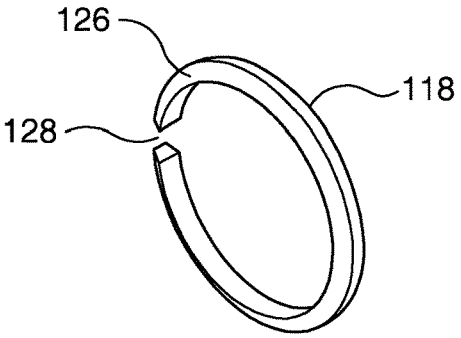
FIG. 12 is a perspective view of a release ring of the tool of FIG. 1.

The ratchet arrangement 16 further comprises a loading arrangement which is configured to apply a suitable load on the ratchet sleeve 102 to press said sleeve 102 against the mandrel when locking therebetween is required. Specifically, the load arrangement comprises a load ring 116 and a dump ring 118 which are both mounted coaxially inside the ratchet guide sleeve 108 and between the lower end of ratchet sleeve 102 and a shoulder 120 formed in a lower portion of the outer sleeve assembly 20. Perspective views of the load ring 116 and dump ring 118 are shown in FIGS. 11 and 12 respectively, reference to which is additionally made.

The load ring 116 defines a tapered surface 122 on an upper side thereof which engages the lower end of the ratchet sleeve 102 such that when an axial compression force is applied between the load ring 116 and ratchet sleeve 102 said sleeve is radially compressed against the mandrel 18, thus locking together the respective ratchet profiles. In this respect the longitudinal split 104 of the ratchet sleeve 102 facilitates such radial compression.

The lower side of the load ring 116 engages an upper side of the dump ring 118 via respective tapered surfaces 124, 126. Further, the dump ring 118 defines a longitudinal split 128 which permits said ring 118 to be radially extended and contracted. In the present described deployment configuration the dump ring 118 is supported by the support ring portion 100 of the ratchet mandrel 90 so as to define a maximum radial extension with radial contraction not permitted. In such a configuration the load ring 116 and dump ring 118 may define a rigid axial structure which can transmit an axial load between the ratchet sleeve 102 and the shoulder 120. However, when the ratchet arrangement 16 is to be deactivated upward movement of the ratchet mandrel 90 relative to the mandrel 18 will cause the support ring 100 to de-support the dump ring 118. In this respect, initial relative movement of the ratchet mandrel 90 may be permitted as the windows 96 of the ratchet mandrel 90 are of a greater axial length than the projections 106 of the ratchet sleeve 102. When the dump ring 118 becomes de-supported any axial force applied between the ratchet sleeve 102 and the shoulder 120 will cause the dump ring 118 to be radially compressed by virtue of the longitudinal split 128 and interaction between the tapered surfaces 124, 126. As such, the effect of the load ring 116 to apply a load on the ratchet sleeve 102 is removed, and the ratchet sleeve 102 may be disengaged from the mandrel 18 as will be described in further detail below.

When the tool 10 is located at the desired position within a bore the tool may be actuated, as illustrated in FIG. 3A, to cause the slip and sealing arrangements 12, 14 to be extended to both anchor the tool 10 within the bore and provide sealing. The form and operation of the tool 10 in this actuated configuration will now be described with reference primarily to FIGS. 3A to 3E.

When actuation is required a setting tool (not shown) may apply a force on both the mandrel 18 and outer sleeve assembly 20 to effect relative axial movement therebetween. The axial force should be sufficient to shear the shear screws 22 (FIG. 2B) and shear screws 72 (FIG. 2E) which are otherwise used to secure the tool 10 in the deployment configuration. The relative movement will cause the slip members 32 of each array 28, 30 to be engaged by the wedge members 34 such that the slip members 32 are pivoted towards an extended position to grip a bore wall. In this extended position, as shown in FIG. 3E, the actuation surface 44 of each slip 32 is supported by a respective wedge surface 42 of the wedge members 34. Furthermore the brace surface 46 of each slip 32 is supported by a respective support surface 66 on the upper and lower slip sleeve 52, 54. As such, each slip becomes robustly supported when in an extended configuration and when significant forces are generated upon engagement with a bore wall. Furthermore, supporting the actuation and brace surfaces 44, 46 of each slip may permit the bosses 50 of each slip 32 to be isolated from any significant reaction forces.

Further, as the wedge members 34 are mounted on respective flat surfaces of the mandrel 18, which at this location is pentagonal in cross-section, the tool 10 becomes located against rotation when the slip members 32 engage the bore wall.

Further, as the slips 32 are pivoted the respective upper and lower biasing sleeves 74 become displaced against their spring bias.

Figure 3B:
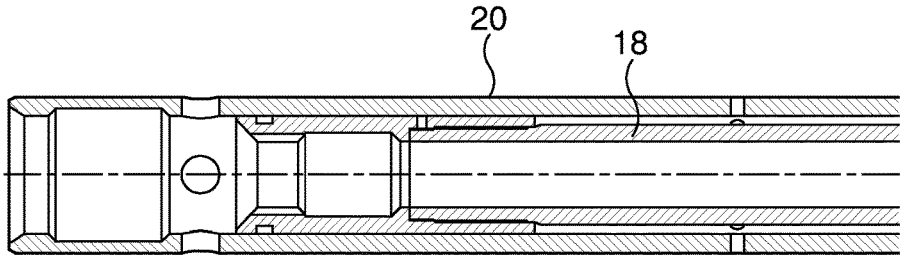
FIGS. 3B to 3E provide enlarged views of regions identified by references 3B to 3E, respectively, of the tool shown in cross-section in FIG. 3A.
Figure 3C:
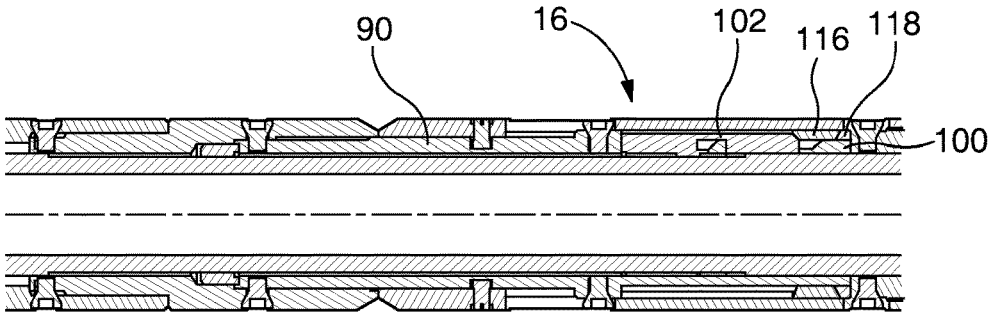
Figure 3D:
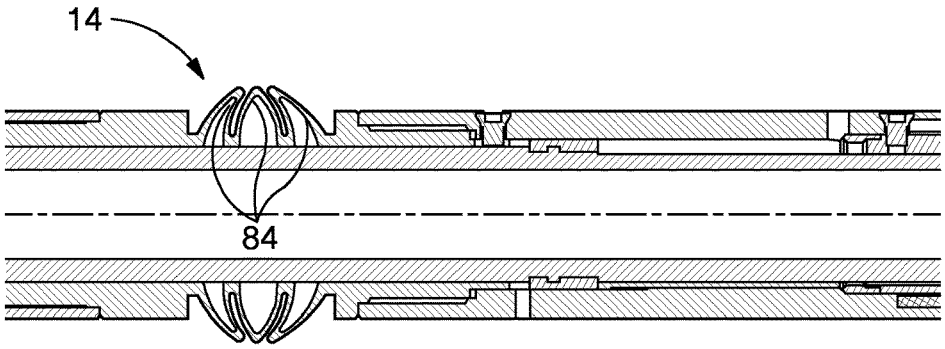
Figure 3E:
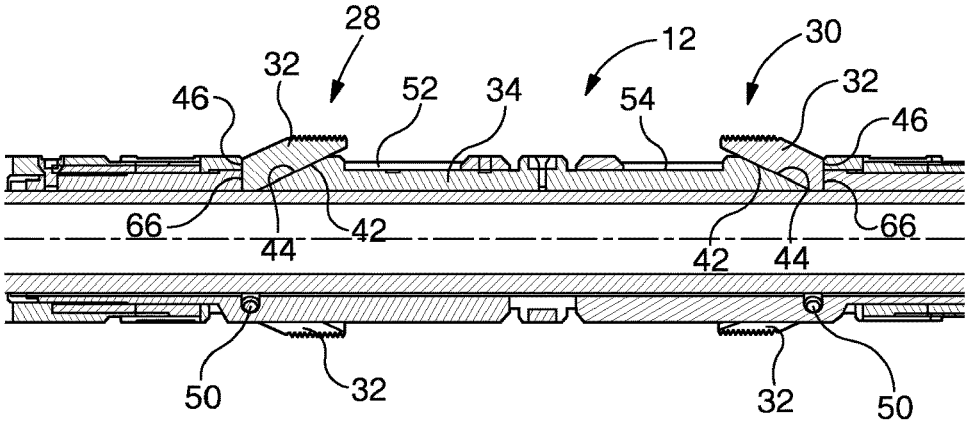

Once the slip members 32 are engaged with a bore wall the axial force applied by a setting tool may be increased to a level sufficient to effect axial compression, and thus radial extension of the sealing segments 84 of the sealing arrangement 14, as illustrated in FIG. 3D.

While the setting tool causes relative movement between the mandrel 18 and outer sleeve assembly 20 the ratchet arrangement 16 functions to prevent any reversing of this relative axial movement which may otherwise release actuation of the tool. In this respect, and with particular reference to FIG. 3C, the axial movement causes the ratchet mandrel 90 to push the ratchet sleeve 102 in a downward direction relative to the mandrel 18. The ratchet profiles on the ratchet sleeve 102 and mandrel 18 are arranged such that relative movement in this direction is permitted. However, in the event of an axial force applied which seeks to move the ratchet sleeve 102 in a reverse direction the load ring 116 and dump ring 118, which in this configuration are supported by the support ring 100 of the ratchet mandrel 90, cause the ratchet ring 102 to be radially compressed such that the ratchet profiles become locked together. Furthermore, the ratchet profiles are arranged to prevent relative axial movement in this reverse direction. Accordingly, any force applied by a setting tool may become "locked-in" and once the tool 10 is fully actuated the setting tool may be removed.

When it is desired to retrieve the tool 10 the tool may be reconfigured to a retrieval configuration, as illustrated in FIG. 4A, in which the slip and sealing arrangements 12, 14 are retracted. The form and operation of the tool 10 in this retrieval configuration will now be described with reference primarily to FIGS. 4A to 4E.

When retrieval is required an un-setting tool (not shown) may be run into the bore to engage the mandrel 18 and outer sleeve assembly 20, for example via profiles 24, 26. The un-setting tool functions to apply an axial force between the outer sleeve assembly 20 and mandrel to effectively seek to move the outer sleeve assembly 20 upwardly relative to the mandrel 18. As noted above, however, the ratchet arrangement 16 is configured to resist such relative movement and therefore must first be deactivated, the process of which will be described with reference to FIG. 4C.

When the force applied by the un-setting tool is of a sufficient magnitude the shear screws 110, which initially rigidly secure the ratchet mandrel 90 to the guide sleeve 108, are sheared, thus permitting relative movement therebetween. As the ratchet mandrel 90 is pulled upwards by virtue of its threaded connection 114 with the outer sleeve assembly 20 the support ring 100 of the ratchet mandrel 90 no longer supports the dump ring 116 and as such the effect of the load ring 116 acting against the ratchet sleeve 102 is removed. Further upward movement of the ratchet mandrel 90 eventually engages the ramp structures 98 of each window 96 with the projections 106 of the ratchet ring 102 thus causing the ratchet ring 102 to be radially extended, by virtue of its longitudinal split 104 (FIG. 10). This radial extension causes the respective ratchet profiles to disengage and thus remove the effect of the ratchet arrangement 16. When the tool 10 is fully configured in the retrieval configuration a ratchet ring 130 mounted on the upper end of the ratchet mandrel 90 is engaged with a further ratchet profile 132 on the mandrel 18. This further ratchet ring 130 functions to lock the tool 10 in the retrieval configuration.

Figure 4B:
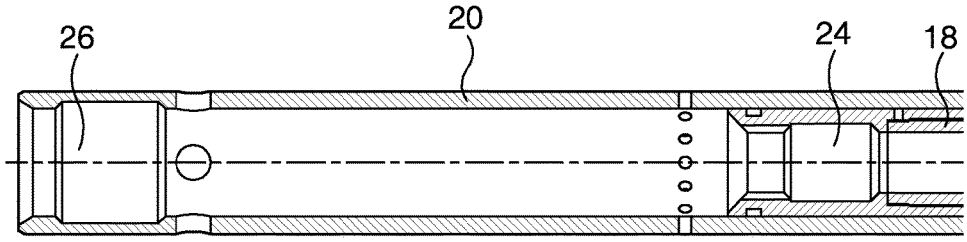
FIGS. 4B to 4E provide enlarged views of regions identified by references 4B to 4E, respectively, of the tool shown in cross-section in FIG. 4A.
Figure 4C:
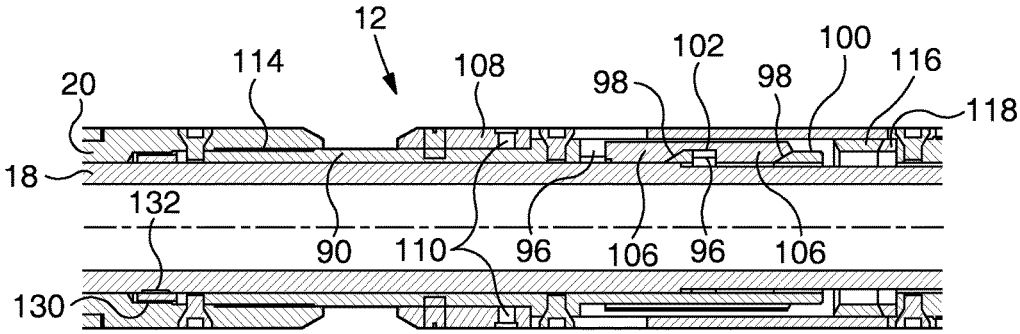
Figure 4D:
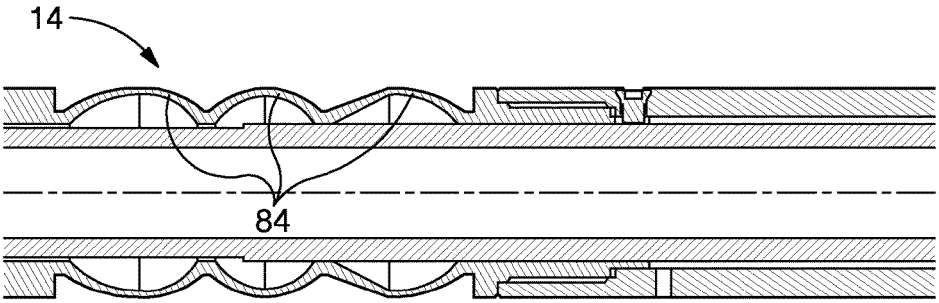

Once the effect of the ratchet arrangement 16 is removed the slip and sealing arrangements 12, 14 are permitted to be retracted. In relation to the sealing arrangement 14, which is illustrated in FIG. 4C, the individual segments 84 are axially extended which causes radial contraction.

Figure 4E:
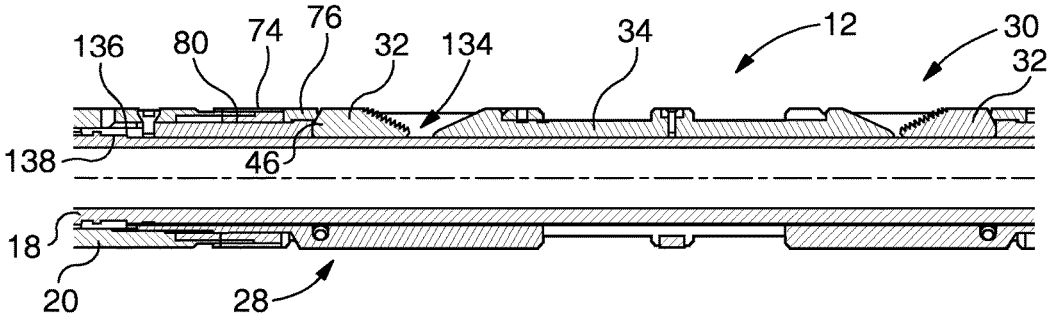

In relation to the slip arrangement, which is illustrated in FIG. 4E, the slip members 32 are removed from the support of the wedge members 34 and the biasing sleeve 74 causes each slip member 32 to pivot towards and be retained in the retracted configuration. It should be noted that the upper array 28 of slip members 32 are afforded an extra degree of axial movement, illustrated generally at 134. This additional axial movement permits a ratchet ring 136 to be engaged with a ratchet profile 138 mounted on the mandrel 18 to effectively assist to lock the tool 10 in the retrieval configuration.

Reference is now made to FIGS. 13 to 16 in which there is shown various view of components of a ratchet mechanism according to an alternative embodiment of the present invention. The ratchet mechanism in this present embodiment may substitute the mechanism 16 of the tool shown in FIG. 1. Further, the ratchet mechanism of this present embodiment is similar in structure and functionality to mechanism 16 previously described, and as such like features share like reference numerals, proceeded with the letter "a".

Figure 14A:
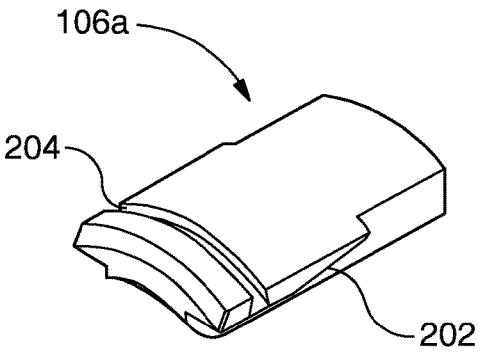
FIGS. 14A and 14B are perspective views, from above and below respectively, of a ratchet slip for use in combination with the ratchet mandrel sleeve of FIG. 13.
Figure 14B:
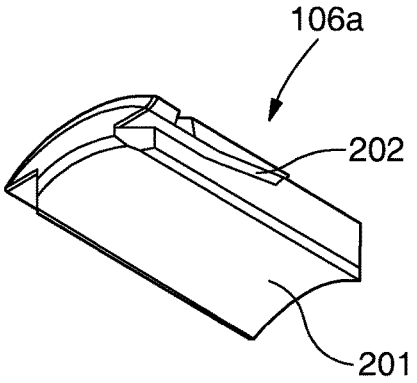
Figure 15:
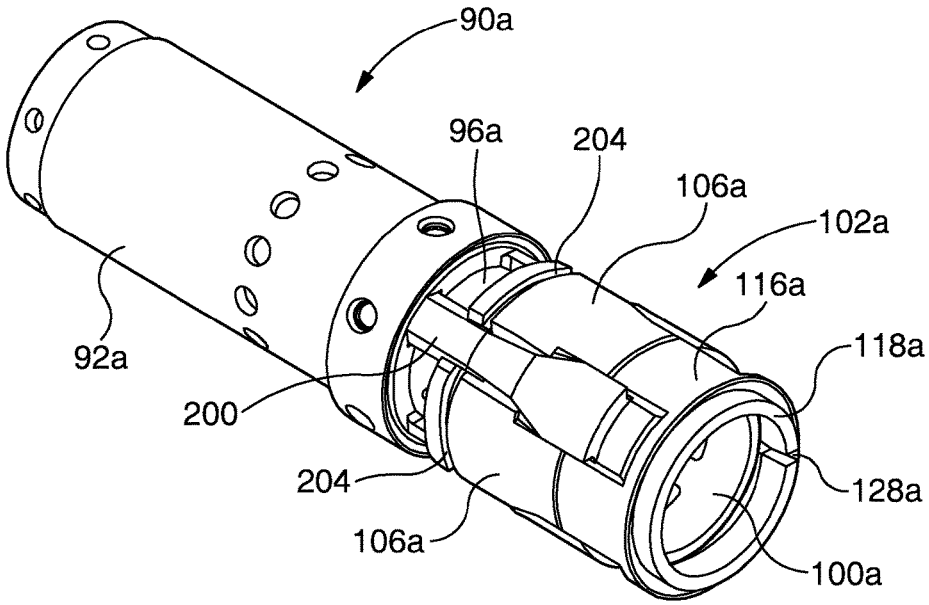
FIG. 15 is a perspective view of the ratchet mandrel sleeve of FIG. 13 and a plurality of ratchet members of FIG. 14 shown assembled together.
Figure 16:
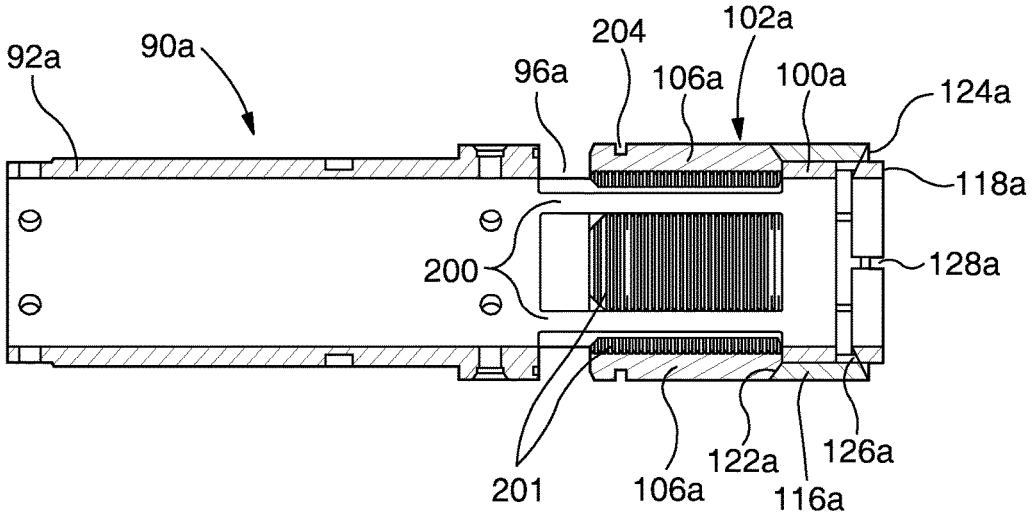
FIG. 16 is a longitudinal cross sectional view of the assembly of FIG. 15.

The ratchet mechanism according to this embodiment includes a ratchet mandrel sleeve 90*a* (e.g., FIG. 13), a circumferential ratchet assembly 102*a* (e.g., FIG. 15) formed from individual ratchet members 106*a* (e.g., FIGS. 14 and 15), and a loading arrangement including load and dump rings 116*a*, 118*a* (e.g., FIGS. 15 and 16).

Figure 13:
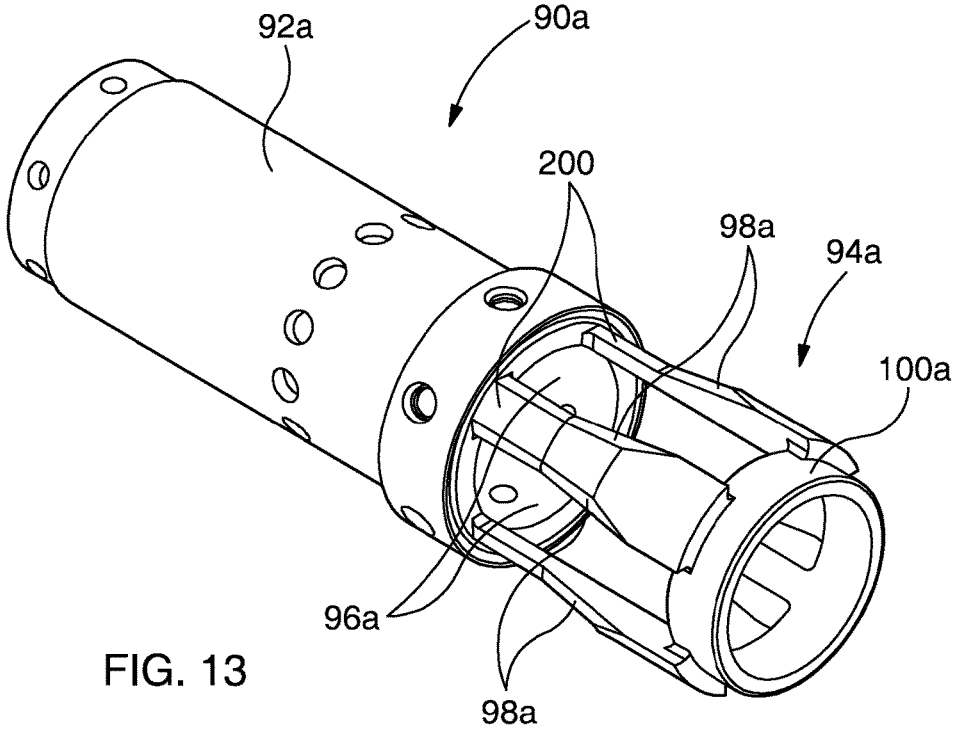
FIG. 13 is a perspective view of a ratchet mandrel sleeve of a ratchet mechanism according to a different embodiment of the present invention, which may be used in the tool of FIG. 1.

The ratchet mandrel sleeve 90*a*, which is shown in isolation in FIG. 13, and which in use will be mounted coaxially on the mandrel 18 of the tool 10 described above, includes an upper cylindrical portion 92*a* and a lower cage portion 94*a*. The cage portion 94*a* in this embodiment comprises a single circumferential array of windows 96*a* defined between ribs 200 which extend axially from the upper cylindrical portion 92*a*. The side regions of each rib 200 include ramp structures 98*a*. A lowermost end of the cage portion 94*a* is defined by a support ring 100*a*, such that the ribs 200 extend between the upper cylindrical portion 92*a* and the support ring 100*a*.

Each window 96*a* of the cage portion 94*a* is configured to accommodate respective ratchet members 106*a*, as illustrated in FIGS. 14A and 14B. When each ratchet member 106*a* is assembled with the ratchet mandrel 90*a* the members 106*a* collectively define a circumferential ratchet assembly 102*a*, as illustrated in FIGS. 15 and 16. Each ratchet member 106*a* comprises a ratchet tooth profile 201 (individual teeth are illustrated only in FIG. 16) on their inner surface, such that when the ratchet members 106*a* extend through respective windows 96*a* in the lower cage portion 94*a* of the ratchet mandrel 90*a* the ratchet tooth profiles 201 of the members 106*a* and those on the mandrel 18 of the tool become engaged.

Each individual ratchet member 106*a* comprises a pair or ramps 202 on opposing sides thereof which are arranged to interengage with the ramp structures 98*a* on the ribs 200 of the cage portion 94*a* of the ratchet mandrel 90*a*. In use, relative axial movement and engagement of the ramp structures 98*a*, 202 may permit the ratchet members 106*a* to be radially extended and permit release of the respective ratchet profiles.

Further, each individual ratchet member 106*a* defines a groove 204 in their outer surface which accommodates an annular band, such as an annular spring structure (not shown), which functions to hold the individual ratchet members 106*a* together.

The loading arrangement in the present embodiment is configured to apply a suitable load on the ratchet members 106*a* to press said members 106*a* against the mandrel when locking therebetween is required. Specifically, the load arrangement comprises the load ring 116*a* and dump ring 118*a*, illustrated in FIGS. 15 and 16. It will be noted that in FIGS. 15 and 16 the loading arrangement is configured such that the ratchet members 106*a* are permitted to be radially extended to disengage the respective ratchet profiles.

In the present embodiment the load ring 116*a* defines a castellated structure to accommodate the ribs 200 and permit engagement with the individual ratchet members 106*a*. Further, each castellation of the load ring 116*a* defines a tapered surface 122*a* (FIG. 16) on an upper side thereof which engages the lower end of a respective ratchet member 106*a* such that when an axial compression force is applied between the load ring 116*a* and ratchet members 106*a* said members are radially compressed against the mandrel 18, thus locking together the respective ratchet profiles.

The lower side of the load ring 116*a* engages an upper side of the dump ring 118*a* via respective tapered surfaces 124*a*, 126*a*. Further, the dump ring 118 defines a longitudinal split 128*a* which permits said ring 118*a* to be radially extended and contracted. When the ratchet profiles are required to be locked together, the dump ring 118*a* is supported by the support ring portion 100*a* of the ratchet mandrel 90*a* so as to define a maximum radial extension with radial contraction not permitted. In such a configuration the load ring 116*a* and dump ring 118*a* may define a rigid axial structure, preventing any radial extension of the ratchet members 106*a* and keeping the ratchet profiles in relative engagement. However, when the ratchet profiles are to be deactivated or disengaged, upward movement of the ratchet mandrel 90*a* will cause the support ring 100*a* to de-support the dump ring 118*a*, as illustrated in FIGS. 15 and 16. In this respect, initial relative movement of the ratchet mandrel 90*a* may be permitted as the windows 96*a* of the ratchet mandrel 90*a* are of a greater axial length than the ratchet members 106*a*. When the dump ring 118*a* becomes de-supported any axial force applied through the ratchet structure will cause the dump ring 118*a* to be radially compressed by virtue of the longitudinal split 128*a* and interaction between the tapered surfaces 124*a*, 126*a*. As such, the effect of the load ring 116*a* to apply a load on the ratchet members 16*a* is removed, and the ratchet members 106*a* may be radially extended by interaction between ramp structures 98*a*, 202, thus disengaging the ratchet profiles.

It should be understood that the embodiment described herein is merely exemplary and that various modifications may be made thereto without departing from the scope of the invention. For example, in the described embodiment that ratchet arrangement functions by a ratchet sleeve which includes a ratchet profile on an inner surface and therefore acts radially inwardly. However, in an alternative embodiment the ratchet sleeve may comprise a ratchet profile on an outer surface and function to act radially outwardly. In such an alternative embodiment the ratchet mandrel may be modified accordingly. Further, any suitable sealing structure may be utilised, such as a compressible solid body, a swellable structure, an inflatable structure or the like.

The invention claimed is:

1. A downhole tool to be positioned and secured within a bore, said tool comprising:

a slip member pivotable about a pivot axis between retracted and extended configurations, the slip member having an actuation surface and a brace surface defining an acute, perpendicular or obtuse angle of separation therebetween;

a wedge member defining a wedge surface, wherein the wedge member and slip member are configured to move relative to each other such that interengagement between the wedge surface and the actuation surface causes said slip member to pivot; and a support surface formed on the tool, wherein when the slip member is in the retracted configuration, the brace surface of the slip member and the support surface of the tool define a relief or separation therebetween, wherein the slit member is configured to pivot about the pivot axis from the retracted configuration to the extended configuration and close the relief or separation between the brace surface and the support surface, and wherein when the slip member is in the extended configuration the actuation surface is in engagement with the wedge surface of the wedge member and the brace surface is in engagement with the support surface formed on the tool.

2. The tool according to claim 1, wherein the angle of separation defines or restricts the permitted angle of pivot of the slip member.

3. The tool according to claim 1, wherein the slip member defines an engagement surface configured to engage a bore wall, such that when the slip member is in the extended configuration said slip member is engaged over three separate surfaces, including the engagement surface, the actuation surface and the brace surface.

4. The tool according to claim 3, wherein the engagement, actuation and brace surfaces of the slip member are mutually non parallel.

5. The tool according to claim 1, wherein the slip member defines a curved surface at a corner region which interconnects the actuation and brace surfaces, wherein the curved surface defines a rolling or bearing contact with a region of the tool during pivoting motion of the slip member.

6. The tool according to claim 1, wherein the pivot axis is provided generally in a corner region of the slip member such that the location of the pivot axis is laterally offset from a longitudinal centre line of the slip member.

7. The tool according to claim 1, wherein the pivot axis of the slip member is defined by a shaft.

8. The tool according to claim 7, wherein the shaft is defined by bosses formed on opposite sides of the slip member.

9. The tool according to claim 7, wherein the shaft is mounted to pivot or rotate on the tool and move linearly on the tool.

10. The tool according to claim 1, wherein the actuation surface of the slip member is planar to define a substantially flat surface, and the wedge surface of the wedge member is planar to define a substantially flat surface.

11. The tool according to claim 1, wherein the brace surface of the slip member is planar to define a substantially flat surface, and the support surface of the tool is planar to define a substantially flat surface.

12. The tool according to claim 1, comprising a plurality of slip members circumferentially distributed about the tool, and a plurality of wedge members circumferentially distributed about the tool.

13. The tool according to claim 1, comprising:

a first circumferential array of slip members;

a second circumferential array of slip members axially spaced from the first circumferential array;

a circumferential array of wedge members interposed between the first and second arrays of slip members, wherein each wedge member is configured to engage a respective slip member in each array.

14. The tool according to claim 1, comprising at least one slip sleeve configured to carry one or more slip members.

15. The tool according to claim 14, wherein the at least one slip sleeve is configured to carry a plurality of slip members in at least one circumferential array.

16. The tool according to claim 14, comprising a plurality of slip sleeves each configured to carry one or more slip members.

17. The tool according to claim 14, wherein one or more slip members are pivotally mounted relative to the at least one slip sleeve.

18. The tool according to claim 14, wherein the at least one slip sleeve defines the support surface of the tool which is engaged by the brace surface of a slip member.

19. The tool according to claim 14, wherein the at least one slip sleeve is temporarily rigidly secured to the wedge member via a releasable connection.

20. The tool according to claim 19, wherein the temporary rigid connection between the at least one slip sleeve and wedge member is arranged to permit a greater relative movement between the wedge member and slip member in a direction to retract the slip member than in a direction to extend the slip member.

21. The tool according to claim 20, wherein the at least one slip sleeve comprises at least one opening within which the slip member is located.

22. The tool according to claim 21, wherein the opening accommodates at least a portion of the wedge member which incorporates the wedge surface.

23. The tool according to claim 1, comprising a biasing arrangement for biasing the slip member in a direction towards a retracted position.

24. The tool according to claim 23, wherein the biasing arrangement comprises an engagement structure for engaging the slip member and applying a bias force thereto.

25. The tool according to claim 24, wherein the biasing arrangement comprises one or more spring structures to act against the engagement structure.

26. The tool according to claim 24, comprising a slip sleeve configured to carry one or more slip members, and being configured to accommodate the engagement structure of the biasing arrangement.

27. The tool according to claim 24, wherein the engagement structure is configured to engage the brace surface of the slip member.

28. The tool according to claim 24, wherein the engagement structure is arranged to engage the slip member at a location which is offset from the slip member pivot axis so as to establish a turning moment in a direction to bias the slip member to pivot in a direction towards the retracted position.

29. The tool according to claim 23, wherein the biasing arrangement comprises a plurality of engagement structures configured to engage respective slip members.

30. The tool according to claim 23, wherein the biasing arrangement comprises a bias sleeve which includes an engagement structure which engages the slip member.

31. The tool according to claim 30, wherein the bias sleeve comprises a plurality of engagement structures arranged to engage respective slip members.

32. The tool according to claim 30, wherein the bias sleeve comprises a plurality of castellations which each define an engagement structure.

33. The tool according to claim 30, comprising a slip sleeve configured to carry one or more slip members, wherein the bias sleeve is generally co-axial with the slip sleeve.

34. The tool according to claim 30, wherein the biasing arrangement comprises a spring or spring like structure configured to act against the bias sleeve.

35. The tool according to claim 1, comprising a mandrel, wherein the wedge member is mounted on the mandrel.

36. The tool according to claim 35, wherein at least one peripheral segment of the mandrel is defined by a planar or flat surface, wherein the wedge member is supported on said planar surface.

37. The tool according to claim 35, wherein at least a longitudinal portion of the mandrel comprise a plurality of peripheral segments defining a planar surface, wherein each planar surface supports a respective wedge member.

38. The tool according to claim 1, comprising a sealing assembly to be radially extended to establish a seal between the tool and a bore wall.

39. The tool according to claim 38, configured such that a common actuation event is used to actuate both the slip member and the sealing assembly.

40. The tool according to claim 1, comprising a ratchet mechanism for preventing retraction of the slip member, and optionally a sealing assembly, during extension thereof, and to lock the slip member, and optionally the sealing assembly, in the extended configuration.

41. The tool according to claim 40, wherein the ratchet mechanism is releasable to permit retraction of the slip member, and optionally the sealing assembly, when desired.

42. The tool according to claim 40, wherein the ratchet mechanism comprises:

a reference member comprising a surface ratchet profile;

a ratchet mandrel sleeve arranged coaxially with the reference member and defining a plurality of circumferentially distributed windows; and a circumferential ratchet assembly arranged generally coaxially with the ratchet mandrel sleeve such that the ratchet mandrel sleeve is interposed between the circumferential ratchet assembly and the reference member, the circumferential ratchet assembly comprising a plurality of circumferentially distributed ratchet members or projections each comprising a surface ratchet profile and arranged to extend through a respective window in the ratchet mandrel to permit relative engagement between the ratchet profiles of the reference member and the ratchet members, wherein the ratchet profiles of the reference member and the ratchet members of the ratchet assembly permit movement of the ratchet mandrel sleeve and ratchet assembly relative to the reference member in a first direction, and resist relative motion in an opposite second direction.

43. The tool according to claim 42, wherein the first direction defines a direction in which the slip member is caused to extend, and the second direction defines a direction in which the slip member is caused to retract.

44. The tool according to claim 42, wherein the reference member comprises a mandrel of the tool.

45. The tool according to claim 42, wherein the respective ratchet profiles of the reference member and the ratchet assembly are arranged to slide across each other when the reference member and ratchet assembly are moved relative to each other in the first direction, and the respective profiles are arranged to become locked together when the reference member and ratchet assembly are moved relative to each other in the second direction.

46. The tool according to claim 42, wherein the circumferential ratchet assembly is configured to be radially extended or displaced to permit the ratchet profiles to slide across each other when the reference member and ratchet assembly are moved relative to each other in the first direction.

47. The tool according to claim 42, wherein the circumferential ratchet assembly is defined by a sleeve structure which carries or is integrally formed with the individual ratchet members or projections.

48. The tool according to claim 47, wherein the sleeve structure is circumferentially split to permit said sleeve structure to be radially extended.

49. The tool according to claim 42, wherein the circumferential ratchet assembly is defined by a plurality of individual ratchet members arranged circumferentially relative to the reference member.

50. The tool according to claim 49, wherein the individual ratchet members are secured together via an annular structure.

51. The tool according to claim 42, wherein the ratchet mechanism comprises a load arrangement configured to apply a load on the circumferential ratchet assembly to prevent radial or circumferential extension of said assembly when the reference member and ratchet assembly are set to move relative to each other in the second direction.

52. The tool according to claim 51, wherein the load arrangement comprises a load ring defining a tapered surface configured to engage a tapered surface on the ratchet assembly, wherein the respective tapered surfaces are arranged such that any relative axial movement in the second direction will apply a radial force on the ratchet assembly thus preventing radial extension thereof.

53. The tool according to claim 52, wherein each ratchet member of the ratchet assembly defines a tapered surface which is engaged by the load ring.

54. The tool according to claim 51, wherein the load arrangement is configured to be deactivated to prevent any load being applied on the ratchet assembly.

55. The tool according to claim 51, wherein the load arrangement comprises a release ring which in a first configuration permits the load ring to apply a load on the ratchet assembly, and in a second configuration prevents or reduces the ability of the load ring to apply a load on the ratchet assembly.

56. The tool according to claim 55, wherein the release ring is configured to be radially or circumferentially extended, wherein when in an extended position the release ring permits the load ring to apply a load on the ratchet assembly, and when in a retracted position the release ring prevents or minimises the ability of the load ring to apply a load on the ratchet assembly.

57. The tool according to claim 55, wherein the release ring is circumferentially split to permit radial extension thereof.

58. The tool according to claim 55, wherein the ratchet mechanism comprises a release ring support which is moveable between supporting and de-supporting configurations, wherein when in the supporting configuration the release ring support supports the release ring in an extended configuration and thus permits the load ring to apply a load on the ratchet assembly, and when in the de-supporting configuration the release ring support does not provide support to the release ring which may be retracted and thus prevents or minimises the ability of the load ring to apply a force on the ratchet assembly.

59. The tool according to claim 58, wherein the ratchet mandrel sleeve defines the release ring support.

60. The tool according to claim 42, wherein the ratchet mandrel sleeve is moveable in one direction to displace the ratchet assembly relative to the reference member in the first direction.

61. The tool according to claim 60, wherein the windows in the ratchet mandrel sleeve have a greater longitudinal width or extent than the ratchet members of the ratchet assembly such that the ratchet mandrel sleeve is configured to be moved relative to the ratchet assembly in an opposite direction to initiate deactivation of the ratchet mechanism.

62. The tool according to claim 61, wherein the ratchet mandrel sleeve is initially prevented from moving in the opposite direction relative to the ratchet assembly by being temporarily locked relative to the ratchet assembly.

63. The tool according to claim 42, wherein the ratchet mandrel sleeve defines a ramp structure configured to engage the ratchet assembly and cause said ratchet assembly to be radially extended to effect disengagement of the ratchet profiles.

64. The tool according to claim 63, wherein each window of the ratchet mandrel sleeve defines a ramp structure configured to engage a respective ratchet member of the ratchet assembly.

65. The tool according to claim 1, wherein the relief or separation defines an angle between the brace surface and the support surface, and the angle of the relief or separation defines a permitted angle of pivot of the slip member.

* * * * *